US008292754B2

(12) United States Patent
Snyder et al.

(10) Patent No.: US 8,292,754 B2
(45) **Date of Patent: *Oct. 23, 2012**

(54) PUTTER HEADS AND PUTTERS INCLUDING POLYMERIC MATERIAL AS PART OF THE BALL STRIKING FACE

(75) Inventors: Jeremy N. Snyder, Benbrook, TX (US); David N. Franklin, Fort Worth, TX (US); Donald S. Rahrig, Mansfield, TX (US); John T. Stites, Weatherford, TX (US)

(73) Assignee: NIKE, Inc., Beaverton, OR (US)

( * ) Notice: Subject to any disclaimer, the term of this patent is extended or adjusted under 35 U.S.C. 154(b) by 12 days.

This patent is subject to a terminal disclaimer.

(21) Appl. No.: 12/907,781

(22) Filed: Oct. 19, 2010

(65) Prior Publication Data

US 2011/0039633 A1 Feb. 17, 2011

Related U.S. Application Data

(63) Continuation of application No. 12/612,236, filed on Nov. 4, 2009, which is a continuation-in-part of application No. 12/467,812, filed on May 18, 2009, now Pat. No. 7,806,779, and a continuation-in-part of application No. 12/123,341, filed on May 19, 2008, now Pat. No. 7,717,801.

(51) Int. Cl.
*A63B 69/36* (2006.01)
*A63B 53/04* (2006.01)

(52) U.S. Cl. ..... 473/251; 473/325; 473/329; 473/331; 473/332; 473/340; 473/342

(58) Field of Classification Search ..... 473/324–350, 473/287–292, 219–256, 313; D21/736–746, D21/759

See application file for complete search history.

(56) References Cited

U.S. PATENT DOCUMENTS

| | | | |
|---|---|---|---|
| 873,423 | A | 12/1907 | Govan |
| 1,289,553 | A | 12/1918 | Sanders |
| 2,005,401 | A | 6/1935 | Storz |
| 2,429,351 | A | 10/1947 | Fetteroff |
| D210,033 | S | 1/1968 | Johnston |

(Continued)

FOREIGN PATENT DOCUMENTS

GB 2388792 A 11/2003

(Continued)

OTHER PUBLICATIONS

Office Action issued in related, U.S. Appl. No. 12/720,623, on May 5, 2011.

(Continued)

*Primary Examiner* — Sebastiano Passaniti
(74) *Attorney, Agent, or Firm* — Banner & Witcoff, Ltd.

(57) ABSTRACT

Golf clubs and golf club heads, such as putter heads, may include a putter body and an insert forming a ball striking face and engaged with the putter body. Portions of the insert may be formed of a metal material, while portions of the insert may be formed of a polymer material. The insert may include a base portion having grooves formed therein. This base may be joined with another material to form the insert. In some arrangements, the insert may be a two-sided, reversible construction and may have different performance characteristics associated with each side of the insert. Methods for making such putter devices are also described.

21 Claims, 24 Drawing Sheets

U.S. PATENT DOCUMENTS

| | | | | |
|---|---|---|---|---|
| 3,979,125 | A | 9/1976 | Lancellotti | |
| 4,679,792 | A | 7/1987 | Straza et al. | |
| D327,931 | S | 7/1992 | Stuff | |
| D327,932 | S | 7/1992 | Stuff | |
| 5,248,145 | A * | 9/1993 | Brown | 473/254 |
| 5,354,059 | A | 10/1994 | Stuff | |
| 5,358,249 | A | 10/1994 | Mendralla | |
| 5,398,929 | A | 3/1995 | Kitaichi | |
| 5,497,993 | A | 3/1996 | Shan | |
| 5,505,450 | A | 4/1996 | Stuff | |
| 5,518,235 | A * | 5/1996 | Mendenhall | 473/314 |
| 5,533,728 | A | 7/1996 | Pehoski et al. | |
| 5,542,675 | A | 8/1996 | Micciche et al. | |
| 5,620,381 | A | 4/1997 | Spalding | |
| 5,637,044 | A | 6/1997 | Swash | |
| 5,655,976 | A | 8/1997 | Rife | |
| 5,766,093 | A | 6/1998 | Rohrer | |
| 5,772,527 | A | 6/1998 | Liu | |
| 5,807,190 | A | 9/1998 | Krumme et al. | |
| 5,944,619 | A | 8/1999 | Cameron | |
| 5,972,144 | A | 10/1999 | Hsu | |
| 6,093,116 | A | 7/2000 | Hettinger et al. | |
| 6,200,229 | B1 * | 3/2001 | Grace et al. | 473/324 |
| 6,302,807 | B1 | 10/2001 | Rohrer | |
| 6,309,310 | B1 | 10/2001 | Shira | |
| 6,334,818 | B1 | 1/2002 | Cameron et al. | |
| 6,431,997 | B1 | 8/2002 | Rohrer | |
| 6,558,272 | B2 | 5/2003 | Helmstetter et al. | |
| 6,699,140 | B1 | 3/2004 | Sun | |
| 6,921,343 | B2 | 7/2005 | Solheim | |
| 7,261,644 | B2 | 8/2007 | Burrows | |
| 7,278,926 | B2 | 10/2007 | Frame | |
| 7,281,990 | B2 | 10/2007 | Hagood | |
| D588,222 | S | 3/2009 | Takahashi | |
| 7,594,862 | B2 | 9/2009 | Gilbert | |
| D605,242 | S | 12/2009 | Franklin et al. | |
| D615,140 | S * | 5/2010 | Franklin et al. | D21/759 |
| 7,717,801 | B2 | 5/2010 | Franklin et al. | |
| 7,758,449 | B2 | 7/2010 | Gilbert et al. | |
| 7,780,549 | B2 | 8/2010 | Park et al. | |
| 7,794,333 | B2 * | 9/2010 | Wallans et al. | 473/331 |
| 7,806,779 | B2 | 10/2010 | Franklin et al. | |
| 7,841,952 | B1 | 11/2010 | Oldknow et al. | |
| 7,846,039 | B2 | 12/2010 | Gilbert et al. | |
| 7,862,449 | B2 | 1/2011 | Stites et al. | |
| 7,927,230 | B2 | 4/2011 | Solheim | |
| 7,942,757 | B2 | 5/2011 | Blumenkrantz et al. | |
| 8,012,035 | B2 | 9/2011 | Franklin et al. | |
| 8,062,146 | B2 * | 11/2011 | Franklin et al. | 473/251 |
| 8,083,605 | B2 * | 12/2011 | Franklin et al. | 473/251 |
| 8,083,611 | B2 * | 12/2011 | Kuan et al. | 473/340 |
| 2004/0242342 | A1 | 12/2004 | Patten | |
| 2005/0009623 | A1 | 1/2005 | Dickinson | |
| 2005/0209020 | A1 | 9/2005 | Burrows | |
| 2005/0233829 | A1 * | 10/2005 | Cameron | 473/340 |
| 2007/0142122 | A1 * | 6/2007 | Bonneau | 473/340 |
| 2007/0161430 | A1 | 7/2007 | Bardha | |
| 2007/0243949 | A1 | 10/2007 | Solari | |
| 2008/0125241 | A1 | 5/2008 | Taleno et al. | |
| 2008/0207351 | A1 | 8/2008 | Wallans et al. | |
| 2008/0293511 | A1 | 11/2008 | Gilbert | |
| 2009/0105008 | A1 | 4/2009 | Kuan et al. | |
| 2009/0131197 | A1 | 5/2009 | Miyamichi | |
| 2009/0149271 | A1 | 6/2009 | Nakamura | |
| 2009/0286620 | A1 | 11/2009 | Franklin et al. | |
| 2009/0286621 | A1 | 11/2009 | Franklin et al. | |
| 2010/0087269 | A1 | 4/2010 | Snyder et al. | |
| 2010/0113179 | A1 | 5/2010 | Solheim | |
| 2010/0167835 | A1 | 7/2010 | Franklin et al. | |
| 2010/0234127 | A1 | 9/2010 | Snyder et al. | |
| 2011/0034268 | A1 | 2/2011 | Franklin et al. | |
| 2011/0039633 | A1 | 2/2011 | Snyder et al. | |
| 2011/0070971 | A1 | 3/2011 | Franklin et al. | |
| 2012/0028731 | A1 * | 2/2012 | Franklin et al. | 473/329 |
| 2012/0083353 | A1 * | 4/2012 | Franklin et al. | 473/251 |

FOREIGN PATENT DOCUMENTS

| | | | |
|---|---|---|---|
| KR | 20080047955 | A | 5/2008 |

OTHER PUBLICATIONS

International Search Report issued in related PCT Application, International Application No. PCT/US2010/051432, on Mar. 30, 2011.

International Search Report issued in PCT Application, International Application No. PCT/US2011/0028674, on Jul. 18, 2011.

Office Action issued in related case, U.S. Appl. No. 12/906,901, on Sep. 23, 2011.

Office Action issued Sep. 4, 2009 in U.S. Appl. No. 12/259,541, also owned by assignee NIKE, Inc.

C-Groove—Development, Harold Swash Putting School of Excellence, (Aug. 26, 2008), http://www.haroldswashputting.co.uk/haroldswash_development.htm.

Rife Two Bar Hybrid Putter Review, Putter Zone Golf, (Mar. 7, 2008), http://www.putterzone.com/2008/03/rife-twobar-hybrid-putter-review.html.

International Search Report in corresponding PCT Application, International Application No. PCT/US2009/044331, mailed Sep. 10, 2009.

Non-Final Office Action in related U.S. Appl. No. 12/870,714 mailed on Dec. 7, 2010.

* cited by examiner

PUTTER HEADS AND PUTTERS INCLUDING POLYMERIC MATERIAL AS PART OF THE BALL STRIKING FACE

RELATED APPLICATION DATA

This application is a continuation of copending U.S. patent application Ser. No. 12/612,236 filed Nov. 4, 2009 in the names of Jeremy N. Synder, David N. Franklin, John T. Stites and Donald S. Rahrig and entitled "Putter Heads and Putters Including Polymeric Material as Part of the Ball Striking Face, which application is a continuation-in-part of U.S. patent application Ser. No. 12/123,341 filed May 19, 2008 (now U.S. Pat. No. 7,717,801) in the names of David N. Franklin and John Thomas Stites and entitled "Putter Heads and Putters Including Polymeric Material as Part of the Ball Striking Face" and U.S. patent application Ser. No. 12/467,812, filed May 18, 2009 (now U.S. Pat. No. 7,806,779) in the names of David N. Franklin and John Thomas Stites and entitled "Putter Heads and Putters Including Polymeric Material as Part of the Ball Striking Face." These priority applications are entirely incorporated herein by reference.

FIELD OF THE INVENTION

The invention relates generally to putter heads and putters. Putter heads and putters in accordance with at least some examples of this invention may be constructed to include a relatively soft polymeric material as at least a portion of the ball striking face.

BACKGROUND

Golf is enjoyed by a wide variety of players—players of different genders and players of dramatically different ages and skill levels. Golf is somewhat unique in the sporting world in that such diverse collections of players can play together in golf events, even in direct competition with one another (e.g., using handicapped scoring, different tee boxes, in team formats, etc.), and still enjoy the golf outing or competition. These factors, together with increased availability of golf programming on television (e.g., golf tournaments, golf news, golf history, and/or other golf programming) and the rise of well known golf superstars, at least in part, have increased golf's popularity in recent years both in the United States and across the world.

Golfers at all skill levels seek to improve their performance, lower their golf scores, and reach that next performance "level." Manufacturers of all types of golf equipment have responded to these demands, and recently, the industry has witnessed dramatic changes and improvements in golf equipment. For example, a wide range of different golf ball models now are available, with some balls designed to complement specific swing speeds and/or other player characteristics or preferences, e.g., with some balls designed to fly farther and/or straighter, some designed to provide higher or flatter trajectories, some designed to provide more spin, control, and/or feel (particularly around the greens), etc. A host of swing aids and/or teaching aids also are available on the market that promise to help lower one's golf scores.

Being the sole instruments that set golf balls in motion during play, golf clubs also have been the subject of much technological research and advancement in recent years. For example, the market has seen improvements in putter designs, golf club head designs, shafts, and grips in recent years. Additionally, other technological advancements have been made in an effort to better match the various elements and/or characteristics of the golf club and/or characteristics of a golf ball to a particular user's swing features or characteristics (e.g., club fitting technology, ball launch angle measurement technology, ball spin rate characteristics, etc.).

Golfers tend to be sensitive to the "feel" of a golf club, particularly with respect to putters. The "feel" of a golf club comprises the combination of various component parts of the club and various features associated with the club that produce the sensory sensations experienced by the player when a ball is swung at and/or struck. Club "feel" is a very personal characteristic in that a club that "feels" good to one user may have totally undesirable "feel" characteristics for another. Club weight, weight distribution, aerodynamics, swing speed, and the like all may affect the "feel" of the club as it swings and strikes a ball. "Feel" also has been found to be related to the visual appearance of the club and the sound produced when the club head strikes a ball to send the ball in motion.

While technological improvements to golf club designs have been made, because of the very personal nature of the putter stroke and the "feel" aspects of putting a golf ball, no single putter structure is best suited for all players. New putter structures that change the look and feel of the club are welcomed by at least some players.

SUMMARY

The following presents a general summary of aspects of the invention in order to provide a basic understanding of this invention. This summary is not intended as an extensive overview of the invention. It is not intended to identify key or critical elements of the invention or to delineate the scope of the invention. The following summary merely presents some concepts of the invention in a general form as a prelude to the more detailed description provided below.

Aspects of this invention relate to putters and putter heads that include: (a) a putter body (made from one or multiple independent pieces or parts) including a ball striking face member made of a material having a first hardness characteristic, wherein a cavity is defined in the putter body behind the ball striking face member, and wherein a plurality of independent and separated openings are defined in the ball striking face member, the independent and separated openings extending rearward with respect to the ball striking face member so as to open into the cavity; (b) a polymeric material provided to at least partially fill the plurality of openings and the cavity, wherein the polymeric material has a second hardness characteristic that is softer than the first hardness characteristic, and wherein the ball striking face member and the polymeric material exposed in at least some of the openings provide a ball striking surface of the putter head; (c) a shaft (or other handle) member engaged with the putter body; and/or (d) a grip member engaged with the shaft member (or other handle member). The polymeric material may completely fill the plurality of openings and the cavity.

The polymeric material generally will lighten the club head structure, and thus allow a club designer to provide weight at other locations in the club head structure (e.g., to increase the club head's moment of inertia characteristics, to control the center of gravity location, etc.). Additionally, the presence of the polymeric material at the ball striking surface (and in contact with the ball during a putt) will influence the ball spin, as well as the sound and "feel" characteristics of the putter (e.g., due to vibration damping effects of the polymeric material).

If desired, the ball striking surface of putter structures in accordance with at least some examples of this invention may include a plurality of grooves defined therein (also call "scorelines"). The grooves or scorelines can help control and produce desired launch angles and/or spin rates of a golf ball during a putt. The grooves may be defined in the material making up the ball striking face member (e.g., between adjacent openings in the ball striking face member), in the polymeric material, or in both the material making up the ball striking face member and the polymeric material. If desired, a single continuous groove may be partially provided in the polymeric material and partially provided in the ball striking face member material immediately adjacent to the polymeric material.

Still other aspects of this invention relate to putters and putter heads having an insert forming the ball striking surface of the club head. In some examples, the insert may be formed of a front plate and a rear backing plate that are co-molded. The front plate may have a plurality of grooves formed therein and may be formed of a metal, while the backing plate may be formed of polymer materials.

In some examples, the ball striking face insert may include grooves formed on two or more sides of the insert. Each side of the insert may include different groove arrangements and/or different materials to alter the performance characteristics of each side of the insert. The insert may be received in a recess or an aperture extending though the club head such that the insert is visible from a front and rear of the club head. In some arrangements, the insert may be removably connected to the club head and may be reversible within the recess or aperture with which it is engaged, e.g., to enable the user to make changes to the putter's construction and/or performance characteristics.

In still other examples, additional weight members, such as tungsten or lead containing weights, may be provided in a rear of the putter head in order to reposition weight associated with the putter head to a rear and/or sides of the club. Additionally or alternatively, a plurality of microgrooves may be formed in the insert, for example, between adjacent grooves. The microgrooves may, in some instances, be between 1 micron and 1 mm deep.

Additional aspects of this invention also relate to methods for making putters and putter heads, e.g., of the various types described above.

BRIEF DESCRIPTION OF THE DRAWINGS

A more complete understanding of the present invention and certain advantages thereof may be acquired by referring to the following detailed description in consideration with the accompanying drawings, in which like reference numbers indicate like features, and wherein.

DETAILED DESCRIPTION

Figure 1A:
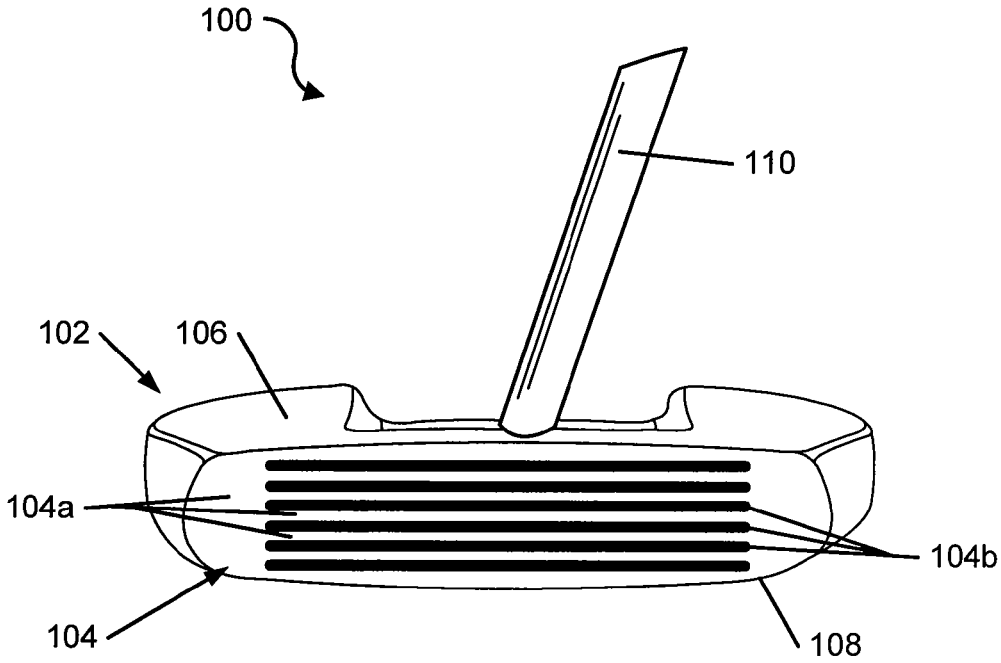
FIGS. 1A and 1B illustrate an example putter structure in accordance with this invention.

In the following description of various example putter heads and other aspects of this invention, reference is made to the accompanying drawings, which form a part hereof, and in which are shown by way of illustration various example structures, systems, and steps in which aspects of the invention may be practiced. It is to be understood that other specific arrangements of parts, structures, example devices, systems, and steps may be utilized and structural and functional modifications may be made without departing from the scope of the present invention. Also, while the terms "top," "bottom," "front," "back," "side," and the like may be used in this specification to describe various example features and elements of the invention, these terms are used herein as a matter of convenience, e.g., based on the example orientations shown in the figures and/or the orientations during typical use. Nothing in this specification should be construed as requiring a specific three dimensional orientation of structures in order to fall within the scope of this invention.

At least some example aspects of this invention relate to putters and putter heads, as well as to methods of making such structures. A general description of aspects of the invention followed by a more detailed description of specific examples of the invention follows.

A. General Description of Putters, Putter Heads, and Methods According to Aspects of the Invention In general, aspects of this invention relate to putters and putter heads. Such golf clubs, according to at least some examples of the invention, may include: (a) a putter body (made from one or multiple independent pieces or parts) including a ball striking face member made of a material having a first hardness characteristic, wherein a cavity is defined in the putter body behind the ball striking face member, and wherein a plurality of independent and separated openings are defined in the ball striking face member, the independent and separated openings extending rearward with respect to the ball striking face member so as to open into the cavity; (b) a polymeric material provided to at least partially fill the plurality of openings and the cavity, wherein the polymeric material has a second hardness characteristic that is softer than the first hardness characteristic, and wherein the ball striking face member and the polymeric material exposed in at least some of the openings provide a ball striking surface of the putter head; (c) a shaft (or other handle) member engaged with the putter body; and/or (d) a grip member engaged with the shaft member (or other handle member). If desired, the polymeric material may completely fill the plurality of openings and the cavity.

If desired, the ball striking surface of putter structures in accordance with at least some examples of this invention may include a plurality of grooves defined therein (also call "scorelines"). The grooves may be defined in the material making up the ball striking face member (e.g., between adjacent openings in the ball striking face member), in the polymeric material, or in both the material making up the ball striking face member and the polymeric material. If desired, a single continuous groove may be partially provided in the polymeric material and partially provided in the ball striking face member material immediately adjacent to the polymeric material.

The plurality of openings in the ball striking face member may be arranged and oriented in a wide variety of ways without departing from this invention. For example, the openings may extend in a parallel or substantially parallel manner across the ball striking surface (e.g., such that the material of the ball striking face member extends between two adjacent openings). The openings may be formed as one or more elongated slots. As additional examples, at least some of the openings may form a design, logo, and/or alphanumeric characters on the ball striking surface. Additionally, any number of openings in any desired arrangement may be provided on the ball striking surface without departing from this invention.

The openings may be sized and arranged in a variety of different manners without departing from this invention. For example, in some putter head products in accordance with this invention, two adjacent openings may be separated by a distance ranging from 0.03 to 0.5 inches, and in some examples, by a distance of 0.1 to 0.3 inches. This separation distance corresponds to the dimensions of the ball striking face member material between adjacent openings. This separation distance may be constant or it may vary along the length of the openings. Likewise, this separation distance may be constant or it may vary among the adjacent openings present in the ball striking face member. Similarly, the openings themselves may have a variety of dimensions without departing from this invention. For example, the openings may extend all the way across the ball striking surface or partially across the ball striking surface (e.g., 10-80% of the way across the ball striking surface, and from 25-75% of the way across the ball striking surface in some examples). The openings may have a height dimension (in the putter head top-to-bottom direction) of any desired value, e.g., ranging from 0.03 to 0.5 inches, and in some example structures from 0.1 to 0.3 inches.

If desired, the cavity defined in the putter body may extend to and open at a port located at an exterior surface of the putter body (e.g., to allow introduction of the polymeric material in to the cavity and/or in to the openings during manufacture). This cavity access port may be located, for example, at a bottom surface of the putter body, at a top surface of the putter body, and/or at a rear surface of the putter body. More than one cavity access port may be provided in a putter head structure without departing from this invention. If desired, when exposed at the top surface of the putter body, the polymeric material (or a cover member provided in the cavity access port) may form at least a portion of an alignment aid for the putter head. The access port may be shaped to provide additional alignment aid features.

The openings may extend rearward from the ball striking surface of the putter body (to the cavity) in any desired manner without departing from this invention. For example, at least some of the plurality of independent and separated openings in a putter body may extend rearward from the ball striking surface in a direction substantially perpendicular to the ball striking surface. In other example structures, at least some of the plurality of independent and separated openings may extend rearward from the ball striking surface at a non-perpendicular angle with respect to the ball striking surface, e.g., at an angle of 10° to 80°, and in some examples structures, at any angle within the range of 30° to 60°. The openings also may extend rearward in a curved or other non-linear or irregular manner.

Additional aspects of this invention relate to methods for making putter devices (such as putters and putter heads of the types described above). Such methods may include, for example: (a) providing a putter body (e.g., by manufacturing it, by obtaining it from a third party source, etc.) including a ball striking face member made of a material having a first hardness characteristic, wherein a cavity is defined in the putter body behind the ball striking face member, and wherein a plurality of independent and separated openings are defined in the ball striking face member, the independent and separated openings extending rearward with respect to the ball striking face member so as to open into the cavity; (b) placing a polymeric material in the putter body to at least partially fill the plurality of openings and the cavity, wherein the polymeric material has a second hardness characteristic that is softer than the first hardness characteristic, and wherein the polymeric material is inserted such that the ball striking face member and the polymeric material exposed in at least some of the openings provide a ball striking surface of the putter head; (c) attaching a shaft member to the putter body; and/or (d) attaching a grip member to the shaft member. The putter devices may have any of the various characteristics described above.

Additional aspects of this invention relate to golf club heads, such as putter heads, having a golf club head body with a front face, a rear portion, a toe end and a heel end. In some examples, a recess may be formed in the front face of the golf club head body. The golf club head further includes a ball striking surface insert configured to be received in the recess formed in the front face of the golf club head body and forming a ball striking surface of the golf club head. In some arrangements, the ball striking surface insert may include a front plate portion formed of a first material and having a plurality of grooves formed in the first material and a backing plate portion engaged with the front plate portion, the backing plate portion being formed of a second material different from the first material. In at least some examples, the first material may be a metal material, such as aluminum, titanium, steel, nickel, beryllium, copper, combinations and/or alloys thereof, etc., and the second material may be a polymer material, such as thermoplastic polyurethane, thermoset material, etc. In other examples, the first material may be a polymer and the second material may be a metal.

The backing plate may be joined with the front plate portion to form the insert in a variety of ways without departing from this invention, e.g., by pressing the plates together, by co-molding, by adhesives or cements, by mechanical connectors, etc. The insert may then be engaged with or connected to the golf club head via at least one of adhesives, fusing techniques (such as welding), mechanical connectors (including releasable mechanical connectors, such as threaded connectors), and the like.

Other aspects of the invention relate to putter heads having a putter body including a top surface, a bottom surface, a rear surface, a front surface, a toe edge and a heel edge. The putter head may further include a front face insert extending from the toe edge to the heel edge of the putter body and engaged with the front surface of the putter body. In at least some examples, the front face insert may be formed of a first, metal material and may have a plurality of grooves formed therein. The putter head may further include a polymer material joined with the front face insert and forming a portion of the ball striking surface. In some arrangements, the polymer material may fill the grooves of the front face insert and may extend along a rear surface of the front face insert. The polymer material may, in some instances, form or include a gasket to aid in sealing the connection between the front face insert and the putter body to prevent moisture, debris, etc. from entering between the insert and the putter body.

In some examples, the plurality of grooves may be formed in a central region of the front face insert and may generally form the ball striking surface. The grooves may extend substantially horizontally across at least a portion of the front face when the putter head is in a ball address position. The term "substantially horizontally," as used herein in this context, means horizontal and any direction within 5 degrees of horizontal. In some examples, the front face insert may include side regions arranged on either side of the central region that may be free of grooves.

Still further aspects of the invention relate to putter heads having a putter body including a top surface, a bottom surface, a rear surface, and a front face. In at least some examples, the putter body may include an aperture extending through the putter body from the front face to the rear surface. The putter head may further include a ball striking surface insert received in the aperture of the putter body and engaged with the putter body. In some arrangements, the ball striking surface insert may include a first surface plate formed of a first material having a plurality of grooves formed therein and a first backing plate engaged with a rear side of the first surface plate and formed of a second material that may be different from the first material. The ball striking surface insert may further include a second surface plate formed of a third material and having a plurality of grooves formed therein and a second backing plate engaged with a rear side of the second surface plate and formed of a fourth material that may be different from the third material. In at least some arrangements, the first surface plate and first backing plate may be engaged with the second surface plate and second backing plate such that the first backing plate and second backing plate may be in contact between the first surface plate and the second surface plate. The first surface plate and second surface plate may form, respectively, a first side of the ball striking surface insert visible on the front face of the putter body and a second side of the ball striking surface insert visible on the rear surface of the putter body.

In some examples, the ball striking surface insert may be releasably or removably engaged with the aperture formed in the putter body such that the insert may be removed and reversed to permit either the first side or the second side to form the front face of the putter body. At least some arrangements include the first side having performance characteristics different from the performance characteristics of the second side. For instance, different materials may be used to provide different hardnesses, sound, and/or other "feel" characteristics to each side of the insert.

In some arrangements, the face loft angle provided by the first side of the insert and the second side of the insert may be the same or substantially similar (when each is mounted as the ball striking face of the club head). Some example inserts may have a loft angle less than 3 degrees. In some particular arrangements, the loft angle may be between 2 and 3 degrees.

In some example putter arrangements, the ball striking face insert may include a casing formed of a first material and having a plurality of grooves formed in an exterior surface of at least one side of the casing. The casing may define a void and the insert may further include a polymer material filling the void defined by the casing. In some arrangements, the polymer material may fill the plurality of grooves formed in the casing and may form a portion of the ball striking surface. In some instances, the casing may include a port through which the polymer fill material may pass to fill the void defined by the casing.

Some examples of this insert structure may also have a plurality of grooves formed in an opposite side of the casing, thereby forming a two-sided insert. In some arrangements, the two sides of the insert may have different performance characteristics and the insert may be releasably connected to the putter body such that the insert may be removed and reversed to alter the performance characteristics of the putter head.

Still other example aspects of this invention relate to putters including a shaft and a putter body connected to one end of the shaft. In some examples, the putter body may include a front face and a recess formed in the front face. The putter may further include a ball striking surface insert configured to be received in the recess formed in the front face of the putter body. The ball striking surface insert may be formed of a polymer material and may have a plurality of grooves formed therein. The putter may further include a plurality of thin metal strips engaged with or formed in a central region of at least a portion of the plurality of grooves. In some examples, a second plurality of grooves may be formed in a rear side of the insert and similar metal strips may be engaged with or formed in the second plurality of grooves to thereby make the insert reversible.

Additional aspects of this invention relate to putter heads having a multi-sided ball striking face insert that may include a first side including a first side plate portion that may have a plurality of grooves formed therein. In some examples, the first side plate portion may be formed of a metal material that forms the majority of the first side plate portion. The first side may further include a first backing portion formed of a polymer material and engaged with a rear surface of the first side plate portion. The multi-sided ball striking face insert may further include a second side including a second side plate portion having a plurality of grooves formed therein. The second side plate portion may be formed of a polymer material that forms a majority of the second side plate portion. In at least some examples, the second side may further include a second backing portion formed of a metal material and engaged with a rear surface of the second side plate portion. In some arrangements, the first side and the second side may be connected to form front and rear sides of the multi-sided ball striking face insert. The performance characteristics of the front side may differ from those of the rear side.

Specific examples of the invention are described in more detail below. The reader should understand that these specific examples are set forth merely to illustrate examples of the invention, and they should not be construed as limiting the invention.

B. Specific Examples of the Invention

The various figures in this application illustrate examples of putters, components thereof, and methods in accordance with examples of this invention. When the same reference number appears in more than one drawing, that reference number is used consistently in this specification and the drawings to refer to the same or similar parts throughout.

Figure 1B:
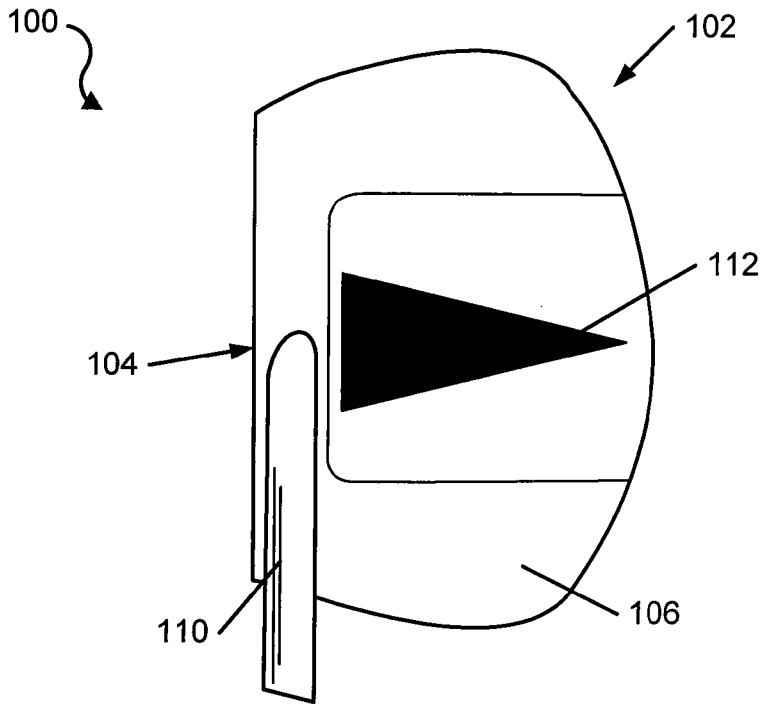

FIGS. 1A and 1B illustrate an example putter structure 100 in accordance with this invention. The putter 100 includes a putter head 102 having a ball striking face 104, a top portion 106, a bottom portion 108, and a shaft member 110 engaged with the putter head 102. The top portion 106 of the putter head 102 may include an alignment aid 112 having any desired shape, structure, etc. The putter head 102 may be made from any desired materials without departing from this invention, including, for example, metals, metal alloys, and the like, including materials that are conventionally known and used in the art. Likewise, the shaft member 110 may be made of any desired materials without departing from this invention, including, for example, metals, metal alloys, composites, and the like, including materials that are conventionally known and used in the art.

As illustrated in FIG. 1A, the ball striking face 104 of the putter head 102 includes at least two different surface features. One portion 104*a* of the putter head 102 is made from the base material for the ball striking face, such as the materials described above for the putter head 102 or other conventional materials used for putter ball striking faces. Another portion 104*b* of the putter head 102 is made from a polymeric material. The polymeric material generally will be softer and more lightweight as compared to the material of the remainder of the ball striking face 104, including portions 104*a*. As illustrated in FIG. 1A, in this example structure, the two portions 104*a* and 104*b* of the ball striking face 104 extend across the ball striking surface of the putter head 102 in an alternating manner, such that a plurality of parallel strips of polymeric material 104*b* are separated by a plurality of strips of the ball striking face material 104*a*. Examples of the construction of putter heads to include this alternating material structure, and other structures including combinations of materials, will be described in more detail below.

One potential advantage of providing a polymeric material within a putter head relates to the potential for weight savings. By removing some of the metal material from the putter head body, this material may be replaced by a lighter weight polymeric material. This weight savings allows the club designer to place additional weight at other areas of the putter head structure, such as toward the rear corners of the putter head structure (as will be described in more detail below). Such features may allow the club designer to control and design a club having higher moment of inertia (resistance to twisting) and desired center of gravity location characteristics. Additionally, by including this relatively soft polymeric material 104*b* as part of the ball striking face (such that the polymeric material 104*b* also directly contacts the ball during a putt), the ball strike characteristics of the putter head may be altered and controlled, which affects the sound, rebound, and other "feel" characteristics of the putter head (e.g., by damping vibrations and altering the sound of a ball strike). The polymeric material 104*b* also may influence ball spin as the ball comes off the putter face. These features also will be described in more detail below.

Figure 2A:
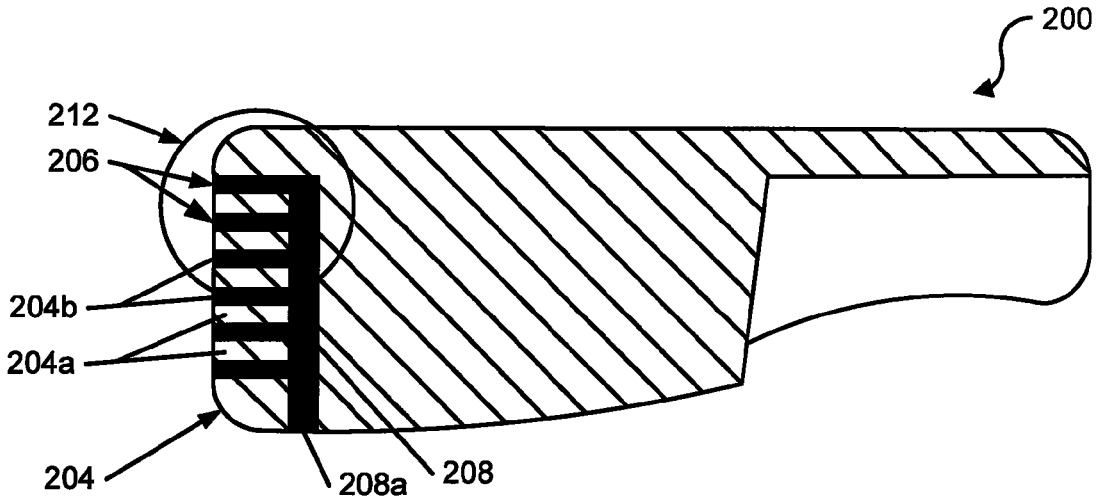
FIGS. 2A through 2D illustrate additional features of polymer filled putter heads in accordance with examples of this invention.

FIGS. 2A through 2D illustrate additional details of a putter head structure 200 in accordance with at least some examples of this invention. FIG. 2A is a cross sectional view taken along a center line of a putter head 200 (between the putter head's heel and toe direction), e.g., like the putter head 102 illustrated in FIGS. 1A and 1B. As shown in FIG. 2A, like FIG. 1A above, the ball striking face 204 of the putter head 200 includes two distinct portions 204*a* and 204*b*, namely, a portion 204*a* made up of the material making the main portion of the ball striking face 204 and a portion 204*b* made from a polymeric material as described above. The polymeric material portion 204*b* is filled into openings (e.g., slots) 206 defined in the ball striking surface 204 of the putter head 200. The openings 206 may be formed in the ball striking face 204 of the putter head 200 in any desired manner without departing from this invention, including, for example, forming the ball striking face 204 to include such openings 206 (e.g., during the molding, casting, forging, or other production process), machining such openings 206 in a solid block of the putter head material, etc. Any desired number of openings 206 may be provided in a ball striking face 204 without departing from this invention.

The openings 206 open at their rear ends into an open cavity structure 208 defined in the putter head structure 200. This cavity structure 208 may be formed in the putter head 200 in any desired manner without departing from this invention, including, for example, forming the putter head 200 to include such a cavity 208 (e.g., during the molding, casting, forging, or other production process), machining such a cavity 208 in a solid block of the putter head material, etc. While a single cavity 208 is illustrated in FIG. 2A and all of the openings 206 open in to this single cavity 208, if desired, multiple cavities 208 may be provided in a putter head structure 200, and the openings 206 may open into any one or more of the available cavities without departing from this invention. In this illustrated example structure, the cavity 208 includes an access port member 208*a* provided in the bottom surface 210 of the putter head structure 200.

Figure 2B:
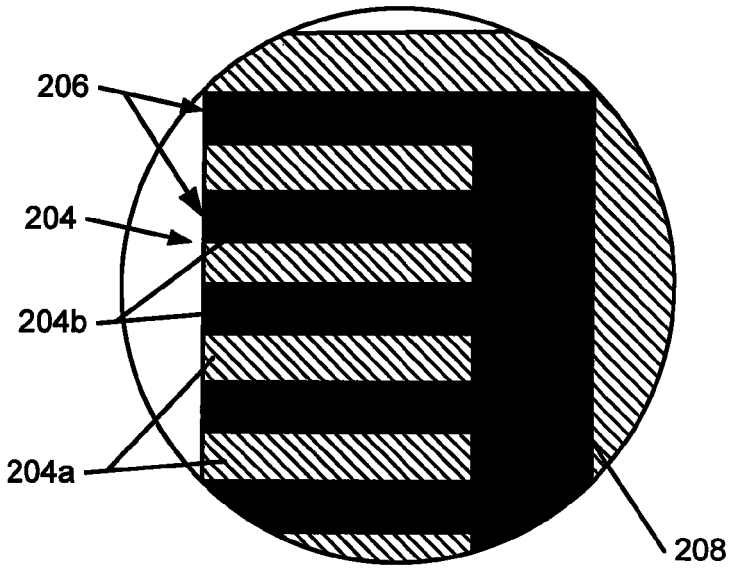

FIG. 2B illustrates an enlarged portion of the putter head structure 200 shown in FIG. 2A (the encircled portion 212 from FIG. 2A). As shown, the ball striking surface 204 includes both the metal (or other) material 204*a* of the ball striking surface of the putter head 200 and the exposed polymeric material 204*b* present in the openings 206 defined in the ball striking surface 204. The openings 206 (and thus the height of the exposed polymeric material 204*b* in the top-to-bottom direction on the ball striking face surface 204) may be made of any desired size without departing from this invention. For example, these openings 206 (and thus the height of the exposed polymeric material 204*b*) may be in the range of 0.03 to 0.5 inches, and in some examples, from about 0.1 to 0.3 inches. Likewise, the height of the metal (or other) material 204*a* between adjacent openings 206 (and thus between adjacent portions 204*b* of the polymeric material) may be made of any desired size without departing from this invention. For example, the height of these portions 204*a* may be in the range of 0.03 to 0.5 inches, and in some examples, from about 0.1 to 0.3 inches. The heights of the portions 204*a* may be less than, equal to, or greater than the heights of the portions 204*b* in a given putter head structure. Additionally, the portions 204*a* and 204*b* may be of a constant size or of different sizes in a given putter head structure without departing from this invention. The heights of these portions 204*a* and 204*b* also may change over the course of the length of the individual portions 204*a* and 204*b* (e.g., in a heel-to-toe direction of the putter ball striking face). A wide variety of potential combinations of sizes of the various portions 204*a* and 204*b* are possible.

The cavity 208 may be placed at any desired position and in any desired orientation in the putter head structure 200 without departing from this invention (and thus, the openings 206 may extend in to the putter head structure 200 any desired distance without departing from this invention). For example, at least some portions of the cavity 208 may be oriented from about 0.25 to 2 inches rearward from the ball striking surface, and in some examples, from about 0.25 to 1 inch rearward. Also, while the illustrated cavity 208 is generally parallel to the ball striking face 204, this is not a requirement. Rather, the cavity 208 can have any desired size, shape, orientation, and orientation with respect to the ball striking face 204 without departing from this invention. As some more specific examples, the cavity 208 may extend in a top-to-bottom direction ranging from 50-95% of the overall putter head height at the location of the cavity 208; the cavity 208 may extend rearward by a distance ranging from 0.25 to 6 inches, and in some examples, from 0.5 to 4 inches or even from 0.5 to 3 inches; and the cavity 208 as well as its port 208*a* may extend in a heel-to-toe direction ranging from 5-95% of the overall putter head heel-to-toe length dimension at the location of the cavity 208 (and in some examples, from 15-85% or even from 25-75% of the overall heel-to-toe dimension at the location of the cavity 208).

Figure 2C:
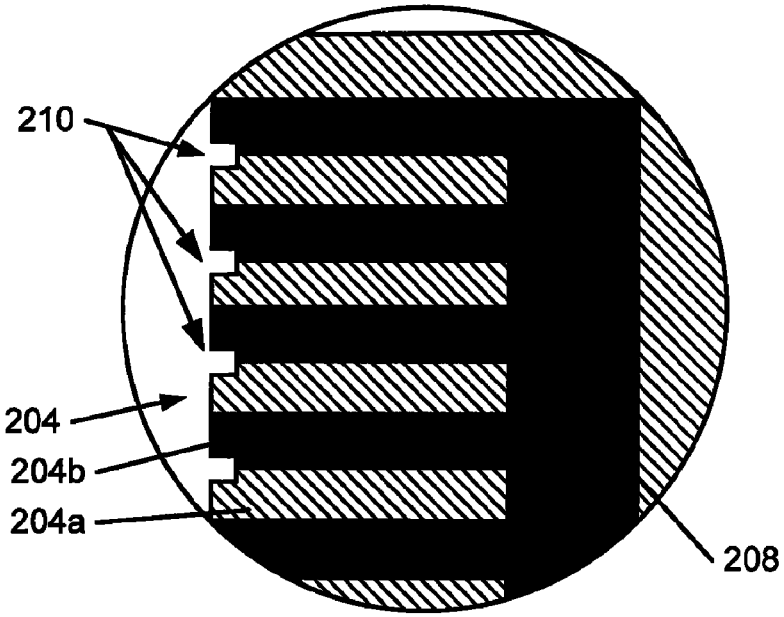
Figure 2D:
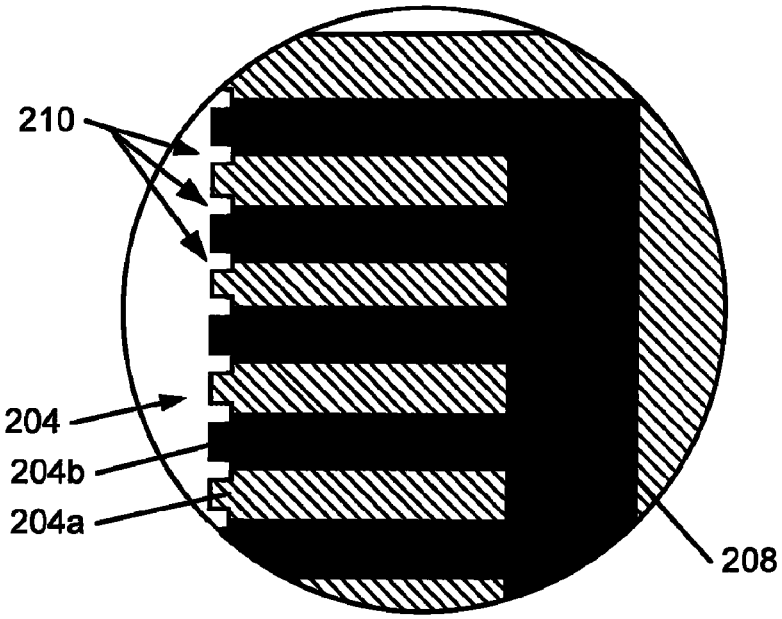

As illustrated in FIG. 2B, the ball striking surface 204 may be smooth (e.g., the portions 204*a* and 204*b* may smoothly transfer from one portion to the next in the alternating portion structure). The ball striking surface 204 may be flat, or it may include some roll or bulge characteristics, and/or it may have some desired loft characteristic. This flat and/or smooth surface 204 is not a requirement. To the contrary, as illustrated in FIGS. 2C and 2D, the ball striking surface 204 may include grooves or scorelines 210 formed therein. In these illustrated example structures, the scorelines 210 are formed at an area of the ball striking surface 204 bridging the junctions between the metal portion 204*a* and the polymeric portion 204*b* of the ball striking surface 204 such that the scorelines 210 are cut into each of these materials 204*a* and 204*b*. The scorelines 210 may be integrally formed in the portions 204*a* and 204*b* when the various parts of the ball striking face 204 are formed (e.g., during the molding, casting, forging, or other forming process), and/or they may be formed at a later time (e.g., after the polymeric material is introduced into the putter head structure and hardened, e.g., by a cutting or machining process). FIG. 2C illustrates an example putter face structure in which the scorelines 210 are formed at the junctions of the bottom of a polymeric portion 204*b* and the top of the adjacent metal portion 204*a*. If desired, this structure could be flipped such that the scorelines 210 are formed at the junctions of the top of a polymeric portion 204*b* and the bottom of the adjacent metal portion 204*a*. FIG. 2D, on the other hand, illustrates another example putter face structure in which the scorelines 210 are formed: (a) at the junctions of the bottom of a polymeric portion 204*b* and the top of the adjacent metal portion 204*a* and (b) at the junctions of the top of a polymeric portion 204*b* and the bottom of the adjacent metal portion 204*a*. In other words, in the structure of FIG. 2C, at least some of the metal portions 204*a* and the polymeric portions 204*b* have a single groove defined therein, whereas in the structure of FIG. 2D, at least some of the metal portions 204*a* and the polymeric portions 204*b* have a two grooves defined therein (one groove at their top and one groove at their bottom).

Providing scorelines (e.g., like scorelines 210) can affect the manner in which the ball leaves the putter head during the course of a putt. For example, the scorelines 210 can affect launch angle and/or ball spin as the ball leaves the putter face during a putt. As one more specific example, in at least some instances, the scorelines 210 and the polymeric material 204*b* will grip the ball somewhat and produce top spin on the ball when putted, which tends to get the ball rolling earlier and truer (e.g., and eliminates some early bouncing during a putt).

The scorelines 210 may have any desired height without departing from this invention. For example, if desired, the scorelines 210 may extend up to 10% of the height of the portion 204*a* and/or 204*b* into which it is provided, and in some examples, up to 25% or even up to 50% or 75% of this height. The scorelines 210 may extend into the portions 204*a* and/or 204*b* (in the front-to-rear or depth direction) a distance of about 0.25 to 2 times the scoreline's height, and in some examples, from 0.5 to 1.5 times the scoreline's height. The various scorelines 210 on a putter face 204 may have the same or different sizes and/or shapes, and every junction and/or every portion 204*a* and/or 204*b* on a given putter structure need not include an associated scoreline 210.

Figure 3:
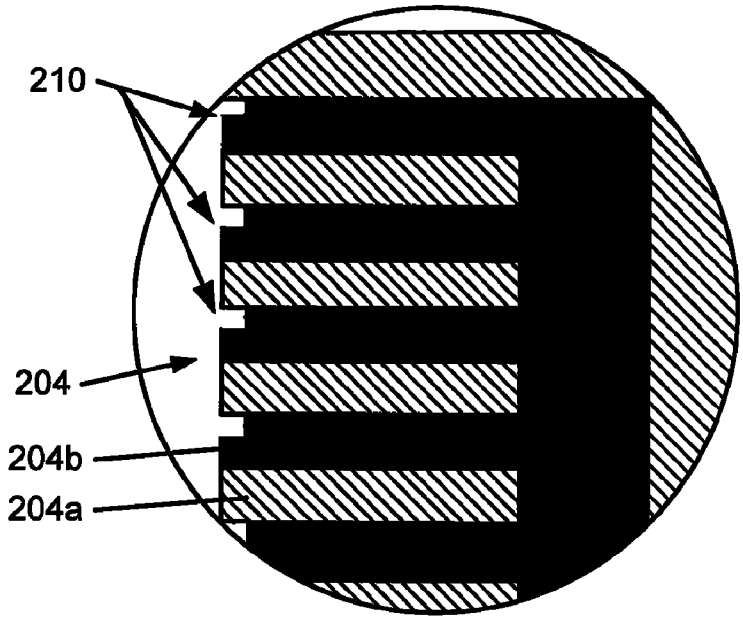
FIGS. 3 and 4 illustrate alternative features of grooves or scorelines that may be included in putter structures in accordance with at least some examples of this invention.
Figure 4:
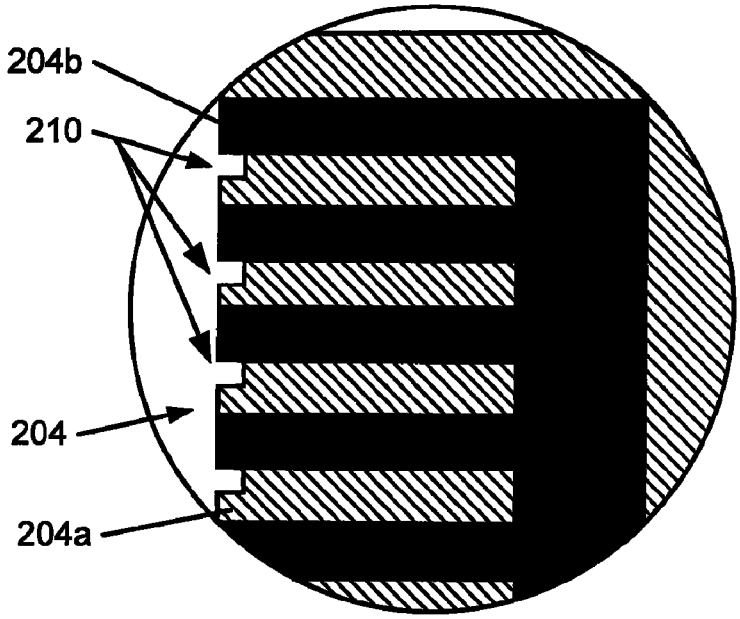

The scorelines 210 may have other constructions without departing from this invention. For example, as illustrated in FIG. 3, the scorelines 210 may be formed solely in the material making up the polymeric portion 204*b* of the ball striking face structure 204. Alternatively, as illustrated in FIG. 4, the scorelines 210 may be formed solely in the material making up the metal (or other base material) portion 204*a* of the ball striking face structure 204. As yet another example, if desired, scorelines 210 of the types illustrated in FIGS. 2C, 2D, 3, and/or 4 may be combined in a single putter head structure without departing from this invention. Also, if desired, in the structures of FIGS. 3 and 4, grooves may be provided at both the tops and the bottoms of the polymeric portions 204*b* (FIG. 3) or the metal portions 204*a* (FIG. 4), without departing from this invention.

Figure 5:
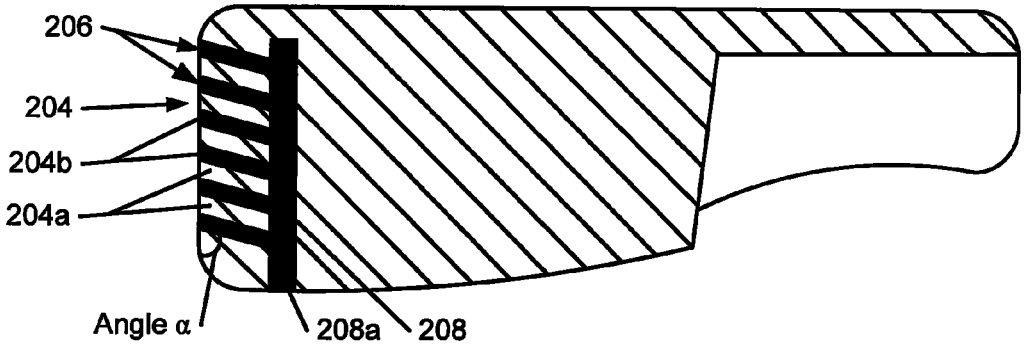
FIGS. 5 through 9 illustrate alternative features of the openings, cavities, and port arrangements that may be included in putter structures in accordance with at least some examples of this invention.

FIGS. 5-9 illustrate additional potential features of putter head structures in accordance with at least some examples of this invention. For example, FIG. 2A illustrates the openings 206 extending rearward from the ball striking face 204 in a direction generally perpendicular to the ball striking face 204. This is not a requirement. For example, as illustrated in FIG. 5, the openings 206 may extend rearward from the ball striking face 204 at a non-perpendicular angle (angle $\alpha$) with respect to the ball striking face 204. This angle $\alpha$ may be in the range of 10-80°, and in some putter structures, in the range of 30-60°. Of course, the openings 206 in a given putter head structure need not extend rearward in parallel (in other words, the rearward extension angle $\alpha$ of the various openings 206 may vary in a single putter head structure without departing from this invention).

Figure 6:
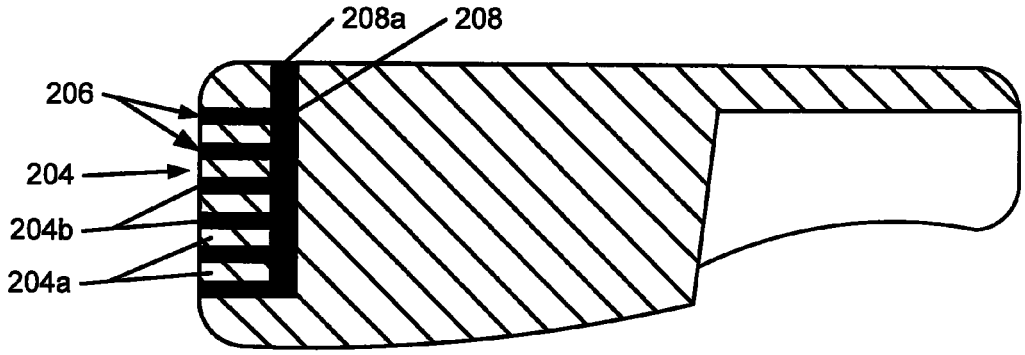

Other variations in the putter head structure are possible without departing from this invention. For example, the port 208*a* of the cavity 208 need not be in the bottom surface of the putter head, as shown in FIG. 2A. Rather, as shown in FIG. 6, the port 208*a* may be provided in the top surface of the putter head. In this manner, if desired (and as will be described in more detail below in conjunction with FIG. 15), the visible polymeric (or other material) present at the port 208*a* may provide at least a portion of an alignment aid for the putter head. While the polymeric material within the cavity 208 may be exposed at the port 208*a* (and at any of the ports described above), if desired, the port 208*a* may be closed by a cover element so that the polymeric material is not directly exposed to the exterior environment at the port 208*a*, and this cover element may function as the alignment aid in the structure of FIG. 6.

Figure 7:
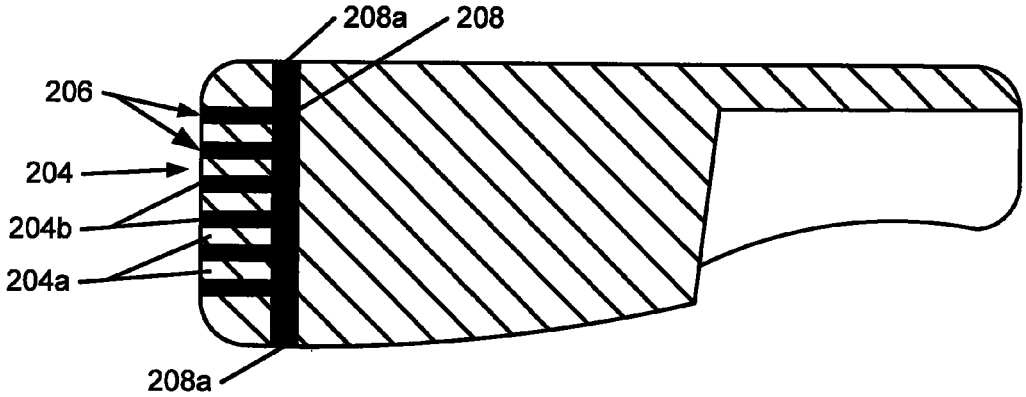

As another potential alternative structure, if desired, more than one port 208*a* may be provided with access to the cavity 208. For example, FIG. 7 illustrates a putter head structure in which both the top and bottom surfaces of the putter head include a port member 208*a* with direct access to the cavity 208. Either or both of these ports 208*a* may be used when filling the cavity 208 and the openings 206 with polymeric material (as will be described in more detail below in conjunction with FIG. 16).

Figure 8:
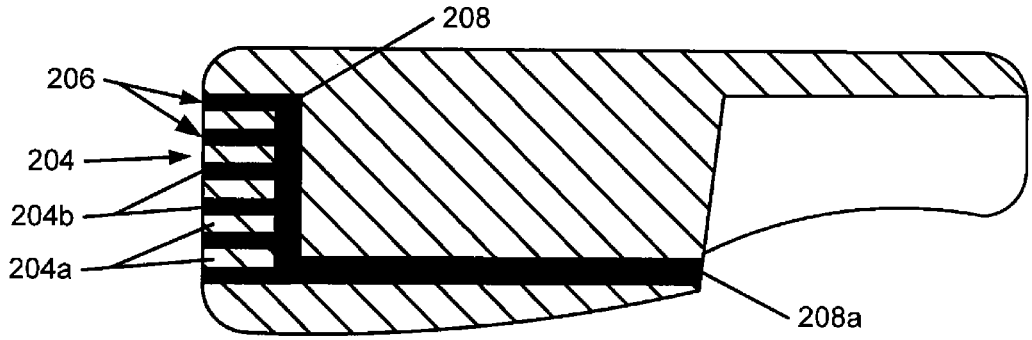

FIG. 8 illustrates yet another example port configuration for a putter structure that may be used in accordance with at least some examples of this invention. As shown in FIG. 8, in this putter head structure the port 208*a* is provided in a rear face surface of the putter structure. Such a port 208*a* location may be desirable, for example, when the putter body is made of a relatively heavy material (such as a relatively heavy metal material) and/or removal of a relatively large amount of this material is desired to lighten the overall putter head structure (i.e., the larger distance between the cavity 208 and the port 208*a* will require the removal of a larger amount of metal material to place the port 208*a* in direct fluid communication with the cavity 208). Of course, more than one port 208*a* may be provided on the rear surface (or on another surface) of the putter structure, if desired. The port 208*a* may have the same dimensions as a cross section of the cavity 208 to which it leads (e.g., the same width and height, the same diameter, the same shape, etc.) or these dimensions or shapes may be different from one another.

Figure 9:
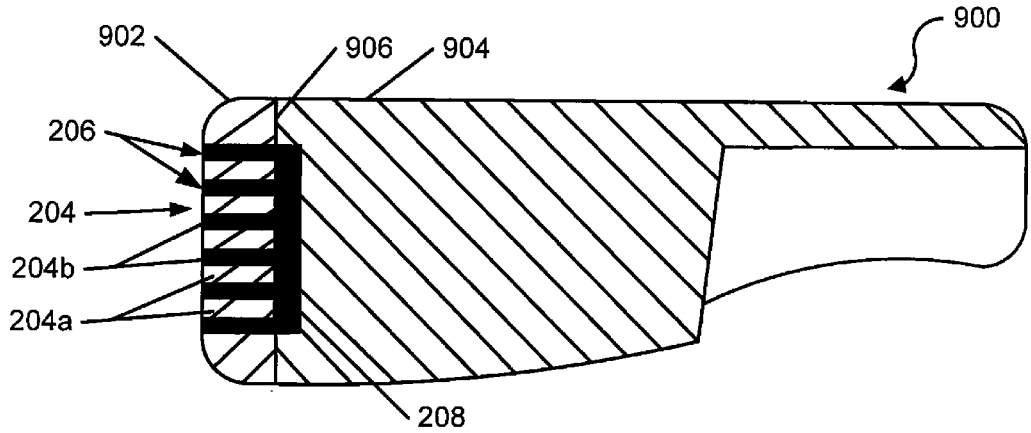

While all of the above examples illustrated a putter structure with one main body part and the polymeric material inserted therein, the invention is not limited to this configuration. Rather, the putter main body may be constructed from multiple parts without departing from this invention. FIG. 9 illustrates an example putter head structure 900 in which the putter head 900 includes a ball striking face portion 902 that is engaged with a main body portion 904. Any desired manner of engaging the ball striking face portion 902 with the main body portion 904 may be used without departing from this invention. For example, these portions 902 and 904 may be engaged by mechanical connectors (e.g., threaded connectors, rivets, etc.), by fusing techniques (e.g., welding, brazing, soldering, etc.), by cements or adhesives, by combinations of these manners, and/or in other manners. Other numbers and combinations of parts may be provided in the overall putter head structure 900 without departing from this invention.

FIG. 9 illustrates additional potential features of putter heads in accordance with this invention. In this example structure 900, no external port 208*a* with access to cavity 208 is present. Rather, in this example structure 900, the cavity 208 is defined in a surface 906 of the main body portion 904 to which the striking face portion 902 is connected (the striking face portion 902 includes the openings 206 defined therein). The openings 206 and cavity 208 may be filled with polymeric material through one or more of the openings 206 located on the ball striking face 204. As additional alternatives, if desired, the cavity 208 may be defined in the rear surface of the striking face portion 902, or the cavity 208 may be partially defined in each of the portions 902 and 904. As yet an additional potential alternative, if desired, the cavity 208 may be omitted (and the various openings 206 may be separately filled with the polymeric material). A single putter head structure also may include any combination of these features, without departing from this invention.

Figure 10:
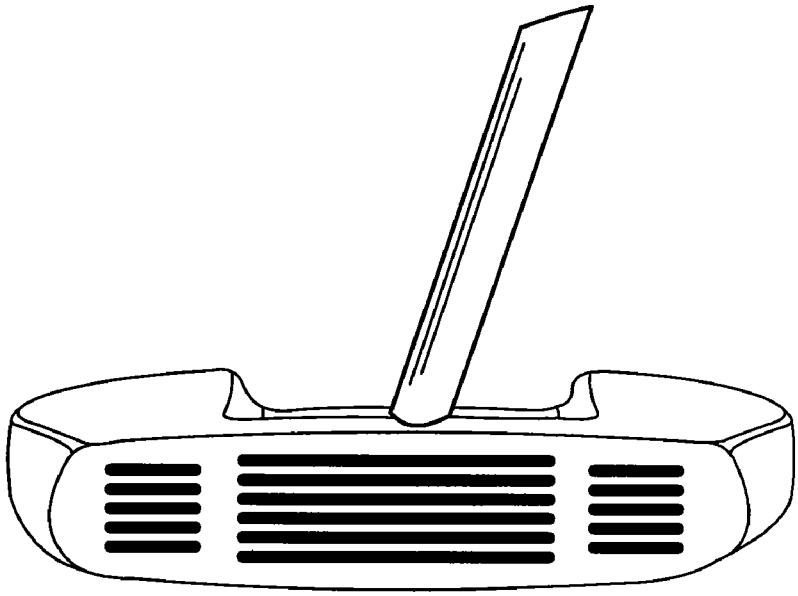
FIGS. 10 through 12B illustrate various examples of the openings and the polymeric material arrangements on the ball striking surface of a putter structure in accordance with this invention.

The openings on the ball striking face through which the polymeric material is exposed also may have a wide variety of configurations without departing from this invention. FIGS. 1A and 2A illustrate the openings (and thus the exposed polymeric material) as a plurality of elongated, continuous slots that extend across the majority of the ball striking face. This is not a requirement. For example, as illustrated in FIG. 10, the ball striking face may include multiple sets of separated openings filled with polymeric material. These sets of openings may align with one another or may be offset from one another as one moves across the ball striking face. The sets of openings may extend to a common cavity in the body member, to different cavities, or to no common cavity at all, if desired. While not illustrated in FIG. 10, if desired, the exposed surfaces of the sets of separated openings may be oriented at different angles from one another and/or may extend rearward at different angles from one another. As yet another example, if desired, the openings within a set need not be parallel to one another.

Figure 11:
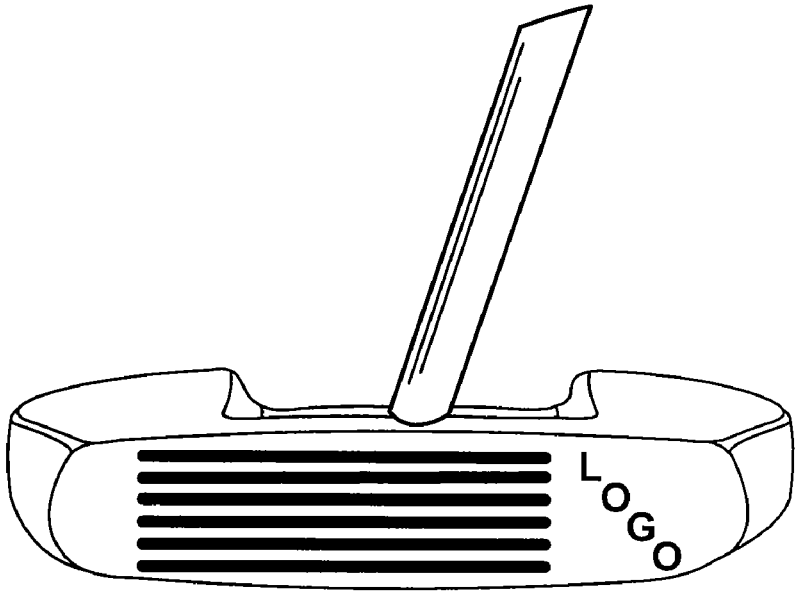

The openings (and thus the exposed polymeric material on the ball striking surface) are not limited to narrow, elongated slots, as illustrated in the previous examples. Rather, if desired, all or some portion of the openings may be of a different shape, e.g., to produce a stylized design, pattern, alphanumeric information, or other information on the ball striking face, such as a logo, manufacturer name, brand name, or trademark information, as illustrated in FIG. 11. This feature also may be used to customize the putter head, e.g., to include a personal name (such as the putter owner's name), a team name, or any other desired information, or to provide an end user (such as the club purchaser or other person) with the ability to design his or her own putter face.

Figure 12A:
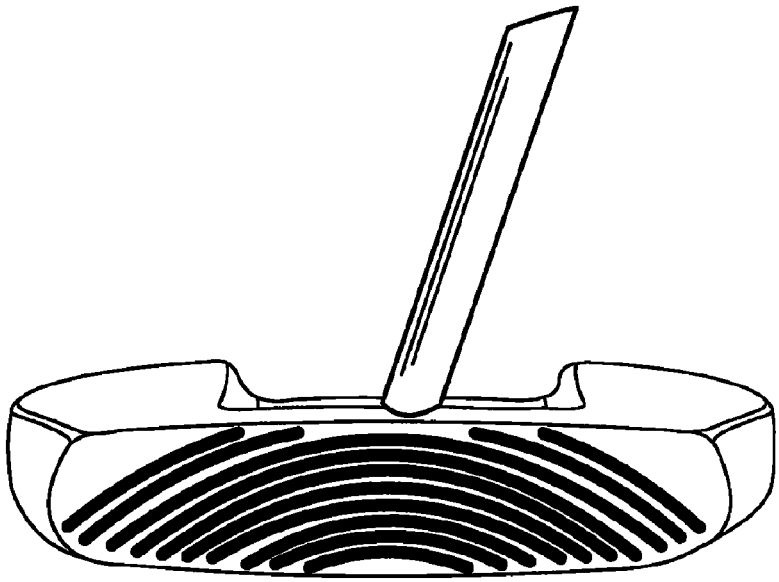

FIG. 12A illustrates yet another pattern of openings (and thus another pattern of exposed polymeric material on the ball striking face surface). In this example construction, the ball striking face includes the openings and the polymeric material arranged in an arched or curved pattern across the ball striking surface. In this structure (as well as the other opening/exposed polymeric material structures described above), grooves or scorelines may be included in the polymeric material, in the material between the polymeric material, or both, e.g., as described above in conjunction with FIGS. 2C, 2D, 3, and 4.

Figure 12B:
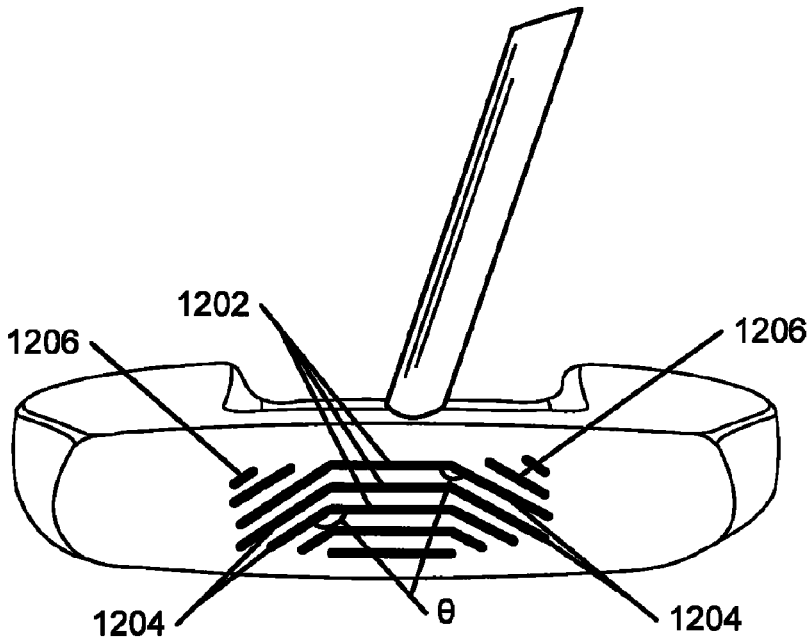

FIG. 12B illustrates another pattern of openings (and thus another pattern of exposed polymeric material on the ball striking face surface). In this example construction, the ball striking face includes the openings and the polymeric material arranged in linear segments across the ball striking surface. In the center of the putter face, a series of generally horizontal linear segments 1202 are provided (when the putter is oriented in a ball address position, as shown in FIG. 12B), and on at least some of these horizontal segments 1202, slanted, linear, downwardly extending end segments 1204 are provided that extend contiguously with the horizontal segments 1202. Any desired angle θ between the slanted, linear end segments 1204 and the horizontal segments 1202 may be provided without departing from this invention. In some more specific examples, θ may be in the range of 10-80°, and in some structures, between 20-70° or even between 30-60°, and the various angles θ within a single putter head may be the same or different without departing from this invention. In addition, if desired, one or more individual slanted segments 1206 may be provided independent of horizontal segments, e.g., at the upper edges of the overall polymeric segment design (running parallel to or substantially parallel to slanted segments 1204 associated with a horizontal segment). As other alternatives, if desired, the slanted segments 1204 and/or 1206 may be parallel or non-parallel, may extend upward or downward, may differ in number from those illustrated, may be discontinuous (spaced apart somewhat) from their associated horizontal segment 1202 (if any), may all extend downward to a common base line of the putter structure (e.g., to a common horizontal line), may all extend downward to different horizontal locations, etc. In this illustrated structure (as well as the other opening/exposed polymeric material structures described above), grooves or scorelines may be included in the polymeric material, in the material between the polymeric material, or both, e.g., as described above in conjunction with FIGS. 2C, 2D, 3, and 4. The slanted segments 1204 and/or 1206 (as well as any grooving or scorelines associated therewith), may help keep the ball on the desired line when hit off-center from the putter face.

The overall pattern of exposed polymeric material at the putter face may extend and span any desired amount across the putter face in the heel-to-toe direction, such as from 25-100% of the face's heel-to-toe direction, from 30-90% of the face's heel-to-toe direction, or even from 40-80% of the face's heel-to-toe direction. In some example structures in accordance with this invention, the overall pattern of exposed polymeric material at the putter face may extend across at least the central 25% of the face in the heel-to-toe direction, and in some examples, the polymeric material will extend across at least the central 40% of the face or across at least the central 50% of the face in the heel-to-toe direction.

Figure 13:
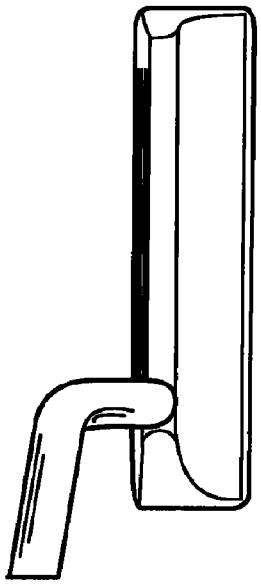
FIGS. 13 through 15 illustrate various example putter head constructions that may include polymer filled openings on the ball striking face and cavities in accordance with examples of this invention.
Figure 14:
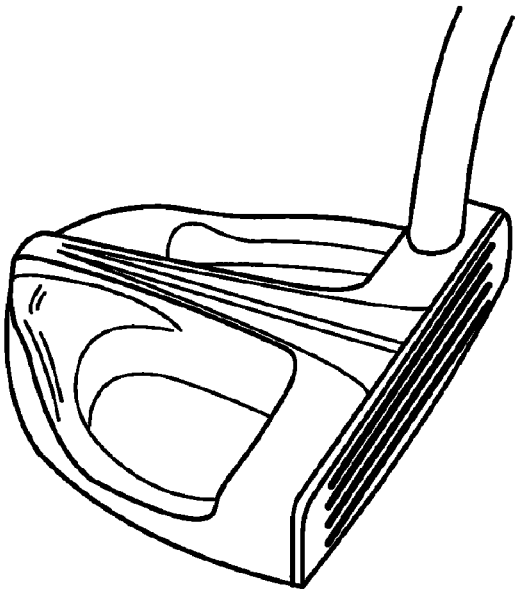

Aspects of this invention may be practiced with any desired putter head construction without departing from this invention. FIGS. 1A through 12B illustrate aspects of the invention included in various mallet type golf putter head structures. As illustrated in FIG. 13, aspects of this invention also may be practiced with blade type putter heads. FIG. 14 illustrates aspects of this invention practiced in a high moment of inertia, large size putter head construction.

Figure 15:
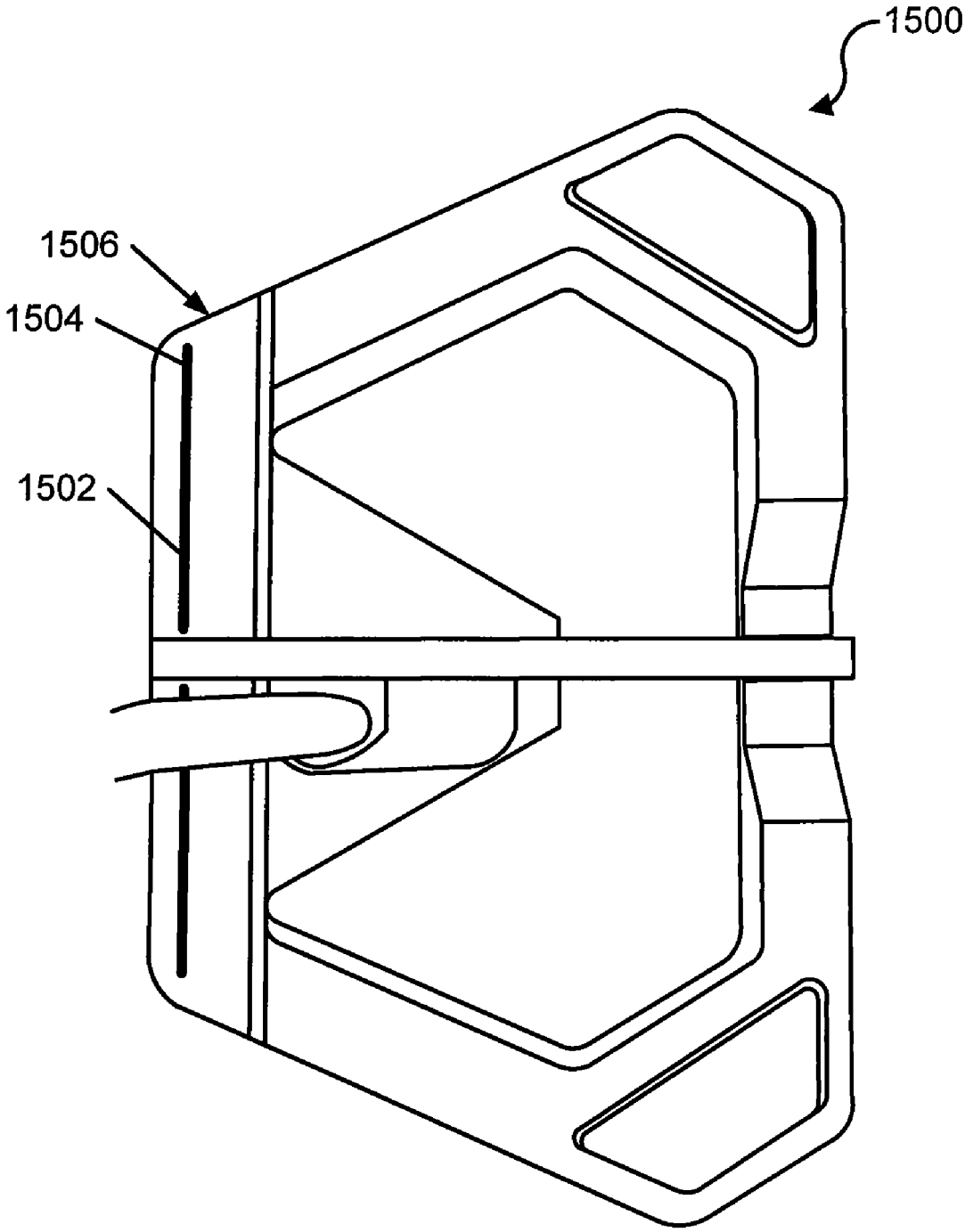

FIG. 15 illustrates aspects of this invention practiced in yet another putter head construction 1500. In this example structure 1500, the port providing access to the cavity defined in the putter body is provided in the top surface 1504 of the putter head's ball striking face 1506. In this structure 1500, the exposed polymeric material 1502 at the top surface 1504 of the putter head 1500 forms a portion of the alignment aid for the putter head 1500. This exposed top surface 1504 port may extend any desired distance along the top of the putter head, e.g., from 25-100% of the overall heel-to-toe width of the putter head at the location of the port, and in some examples, from 50-95% and even from 50-85% of the overall heel-to-toe width at the location of the port. As noted above, however, rather than directly exposing polymeric material 1502, the port may be closed by a cover member to prevent direct exposure of the polymeric material 1502. The exposed polymeric material and/or the cover member may be made of any desired color without departing from this invention.

The invention is not limited to use in the various putter constructions shown. Rather, aspects of this invention may be used in the construction of any desired putter construction, including general putter constructions and styles that are known and used in the art.

Figure 16:
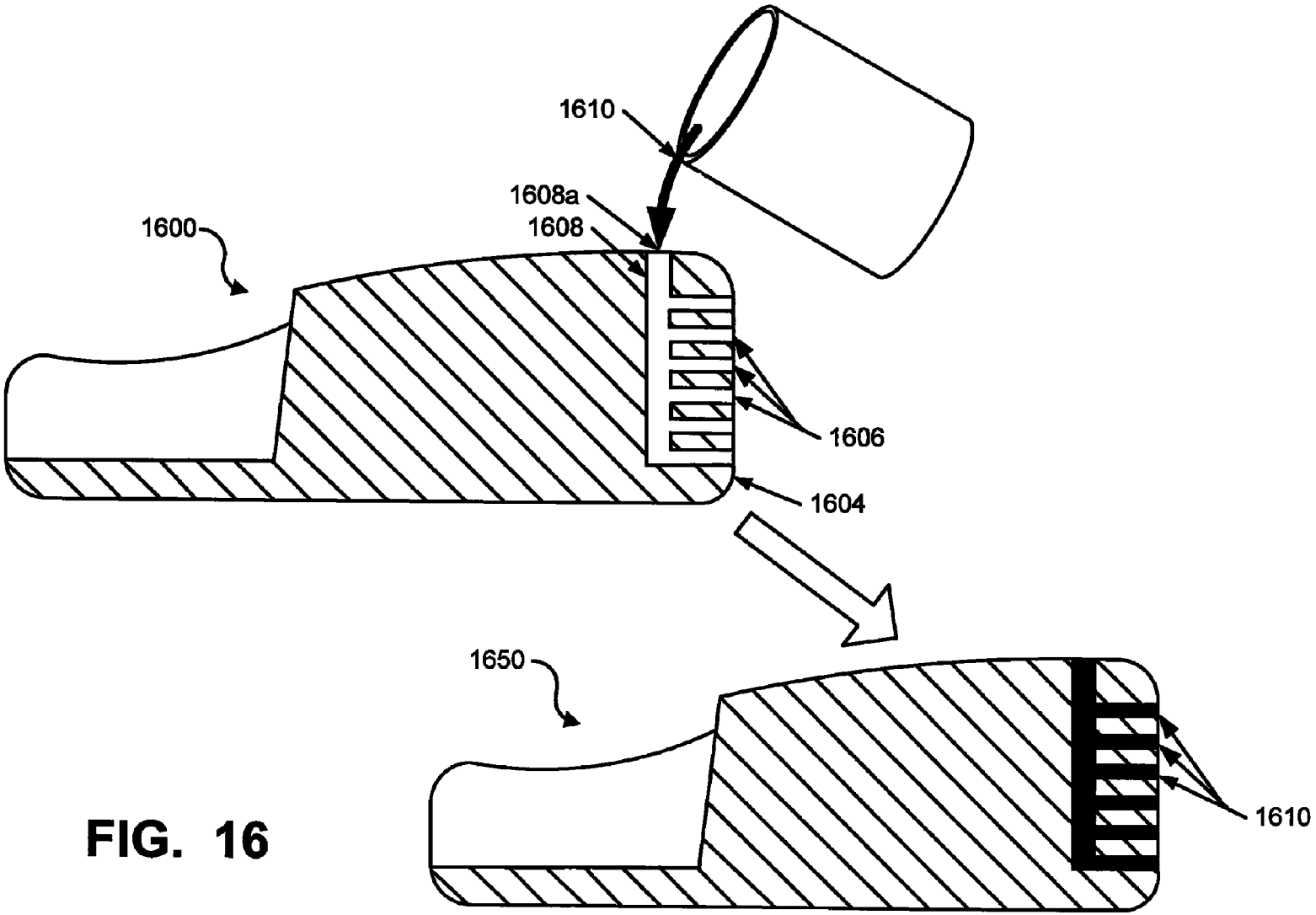
FIG. 16 provides an illustrative aid for explaining various example methods of making putter heads in accordance with this invention.

FIG. 16 generally illustrates one manner of making putter head constructions in accordance with examples of this invention. The method begins with a general putter body 1600 (or a putter ball striking face member) into which a cavity 1608 has been provided and into which a plurality of openings 1606 have been provided in the ball striking surface 1604. The cavity 1608 and the openings 1606 may be provided in the putter body structure 1600 in any desired manner without departing from the invention, such as by machining them in, by molding or casting them in, by forging, etc. Liquid polymer material (or a precursor thereof) 1610 is introduced into the cavity 1608 via port 1608*a*. The liquid polymer material 1610 flows from the cavity 1608 to fill the openings 1606 and the channels extending rearward therefrom. If desired, prior to introducing the polymer material 1610, the putter body 1600 (or at least some portions thereof) may be fit into a mold or other suitable structure to hold the liquid polymer in place (and optionally, if desired, to form scorelines in the polymer). The polymeric material 1610 may be introduced by pouring, by injection molding processes (e.g., under pressure), or the like. Once introduced, if necessary, the polymeric material 1610 may be exposed to conditions that enable it to harden, such as to cool temperatures; to high temperatures; to pressure; to ultraviolet, infrared, or other radiation; etc. The final putter body 1650 (including the cured polymeric material 1610 therein), may be further processed in any desired manner, e.g., by painting, anodizing, or other finishing processing; by cutting scorelines or grooves into the face of the putter head (e.g., as described above); by adding a shaft and/or grip member to the club head; etc.

Figure 17A:
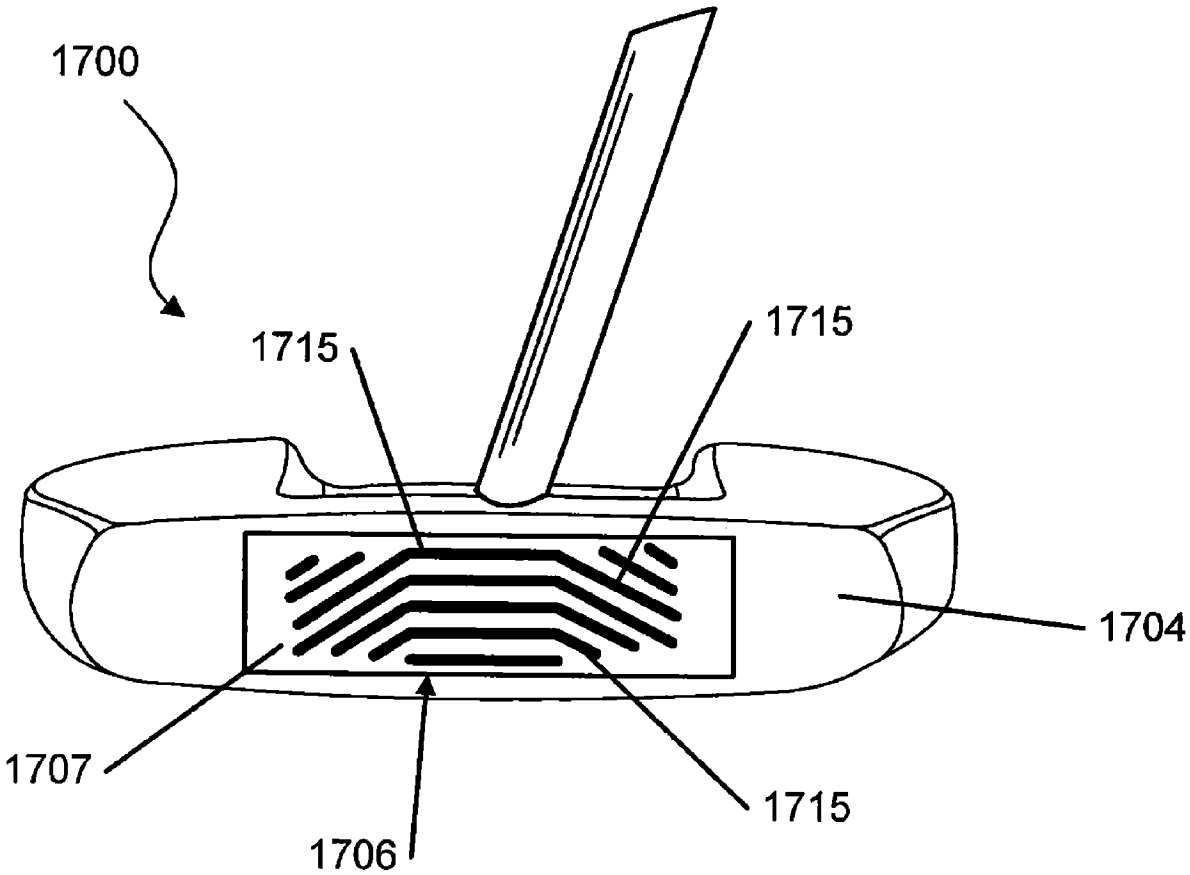
FIG. 17A-17B illustrate an alternative putter arrangement having a ball striking face insert formed at least partially from a polymer material in accordance with at least some aspects of this invention.
Figure 17B:
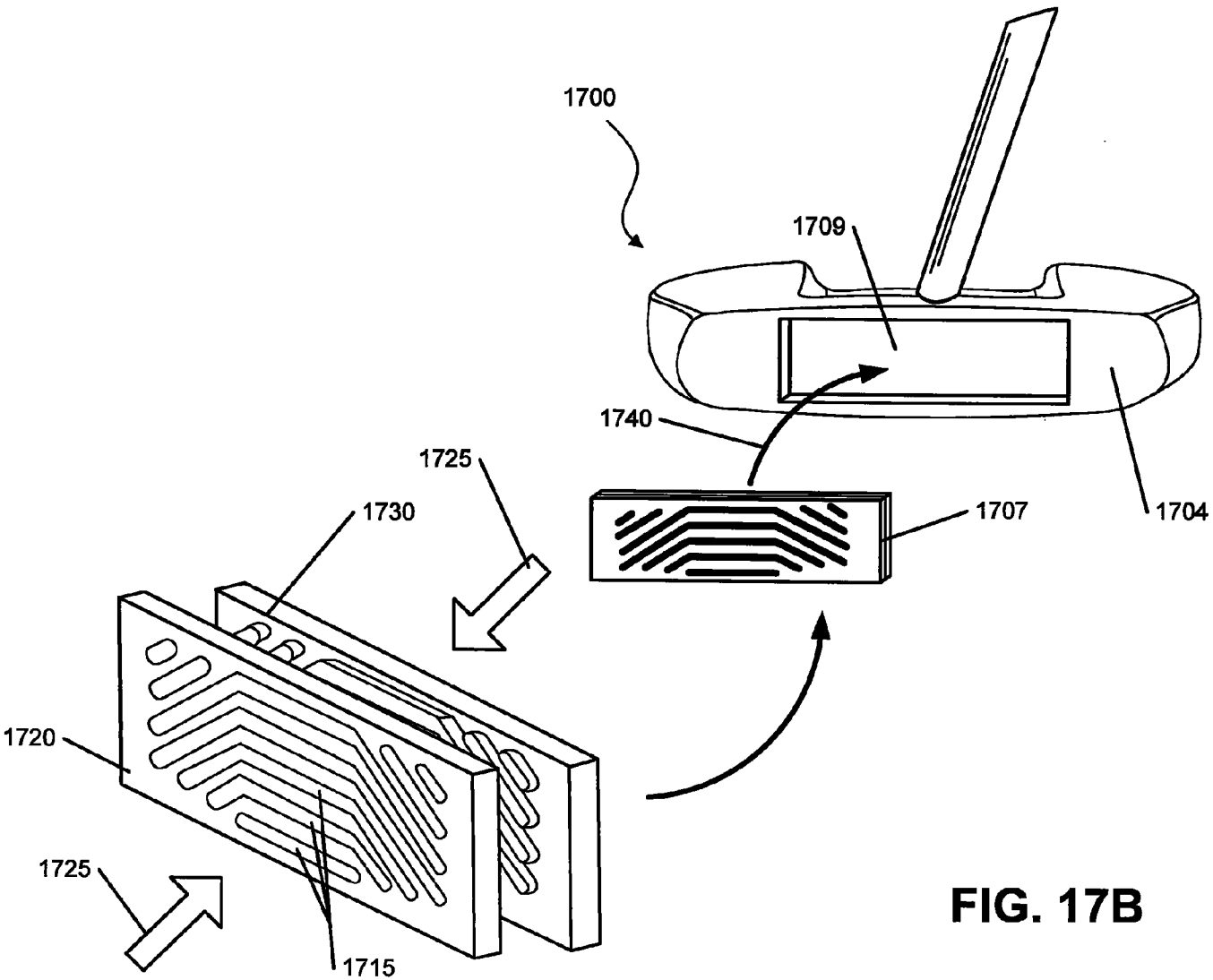

Other club constructions are possible without departing from this invention, and FIGS. 17A and 17B illustrate another example golf club head 1700 for use with a golf club, such as a putter. Similar to the arrangements described above, the golf club head 1700 includes a front face 1704 including a ball striking surface 1706. In the arrangement of FIGS. 17A and 17B, at least a portion of the ball striking surface 1706 may be formed separately from the remainder of the front face 1704 and may comprise an insert 1707 configured to be received in a recess, such as recess 1709 shown in FIG. 17B, formed in the front face 1704 of the golf club head 1700.

In at least some examples, the insert 1707 may include a plate, such as a front plate portion 1720, into which grooves of various sizes, configurations, shapes, etc. may be machined or otherwise formed. In some examples, the plate 1720 may be between 1 mm and 4 mm thick and, in some examples, may be approximately 2 mm thick. As mentioned, the plate 1720 may include grooves 1715 formed therein. The grooves 1715 may, in some arrangements, extend completely through the plate 1720 (i.e., forming a through hole in the plate) or may extend partially through the plate 1720. Additionally or alternatively, the grooves 1715 may have a constant depth, width, height, etc. across the plate 1720. However, in some examples, the depth, width, height, etc. of one or more grooves 1715 may vary along the length of the groove 1715, along the plate 1720, and the like. Additionally or alternatively, the grooves 1715, or a portion thereof, may be arranged generally horizontally across the face of the golf club head 1700 when the club is in a ball address position. In other arrangements, the grooves 1715 may extend in a non-horizontal linear, circular, semi-circular, or other curved pattern on the face.

The plate 1720 may be formed of any suitable material, including metals such as aluminum, steel, titanium, nickel, beryllium, copper, combinations or alloys including these metals, and the like. Once the grooves 1715 are formed in the plate 1720, the plate 1720 may be pressed together ("co-molded") with a moldable, polymer material backing 1730, such as thermoplastic polyurethane or a thermoset material. In some examples, the polymer material 1730 may have a hardness range between 25 and 85 Shore D. In some specific examples, the polymer material backing 1730 may have a hardness range between 35 and 45 Shore D, 50 and 60 Shore D or 60 and 70 Shore D. Forcing the polymer material 1730 together with the front plate 1720 (for example, as indicated by arrows 1725) forms the insert 1707 (as shown in FIG. 17B) having polymer material filling the grooves 1715 formed in the plate 1720 to provide a ball striking surface having both metal and polymer contacting the ball. The surface of the polymer backing material 1730 may be pre-formed with projections 1732 to fit into grooves 1715, and/or the polymer material 1730 may be forced into the grooves 1715 during the pressing operation. This combination of metal and polymer materials on the ball striking face may provide improved performance of the golf club including softer feel, increased spin rate, more true roll, a more metallic ball striking sound, etc.

In some examples, during the pressing or co-molding process, the front surface of the plate 1720 (which will correspond to the face plate of the putter) may be held against a mold surface so that scorelines may be formed in the polymer material. Optionally, if desired, some portion of the scorelines may be cut into the metal portion of the grooves either before or after the co-molding or pressing process. Alternatively, if desired, the score lines may be cut into the polymer and/or metal of the plate after the insert 1707 has been made.

The insert 1707 may be engaged with a recess 1709 formed in the front face 1704 of the golf club head 1700 (as indicated by arrow 1740) in any desired manner. For instance, the recess 1709 may be milled or otherwise machined into the front face 1704 during manufacture, or it may simply be formed into the desired shape, e.g., during a molding, casting, forging, or other fabrication operation. The insert 1707 may be shaped to correspond to the shape of the recess 1709 and may be configured to be received in the recess 1709. The insert 1707 may be engaged with or connected to the recess 1709 and/or the golf club head 1700 in any desired manner, such as via adhesives and cements; via fusing techniques (e.g., welding, soldering, brazing, etc.); via mechanical fasteners or connectors (including releasable mechanical connectors); and the like. If desired, the insert 1707 may rest on a ledge or other structure defined in the recess 1709 (e.g., along the side, top, and/or bottom edges of the recess 1709).

In some examples, the insert 1707 may be removable to allow for customization and/or personalization of the insert 1707 and/or golf club head 1700. For instance, the insert 1707 may be releasably connected to the golf club head 1700 using mechanical connectors to secure the insert 1707 in the recess 1709 (e.g., screws, bolts or other connectors may extend from a rear side of the golf club head toward a front region of the golf club head to engage threaded regions provided on the insert 1707, it may be engaged from the bottom surface of the putter upward, it may be engaged from the top surface of the putter downward, etc.). Personalization and customization features may include various characteristics such as polymer and/or metal color (e.g., team colors, color associated with a cause or promotion, player preference, etc.); polymer and/or metal hardness (e.g., harder or softer for different play conditions or swing types); graphics on the polymer and/or metal (e.g., logos, etc.); etc.

In some arrangements, the metal plate 1720 may be replaced by a plate formed of a polymer of a different hardness from the backing material polymer 1730, thereby forming an insert 1707 of all polymer. For instance, the metal plate 1720 may be replaced with a plate formed of a polymer material having a higher Shore hardness value than the polymer 1730 filling the grooves 1715 of the insert 1707. This all polymer insert may aid in further reducing weight associated with the golf club head 1700. Additionally or alternatively, the polymer material 1730 may be replaced with a metal of a different hardness from the original metal, thereby forming an insert of all metal.

If desired, the rear surface of recess 1709 may be formed to include a polymer or other material to provide a consistent backing or base against which insert 1707 is mounted. As another alternative, if desired, the material of the polymer backing layer 1730 may be included in the recess 1709 and the club head may be formed by pressing plate 1720 against the polymer backing material 1730 in the recess 1709 to force the polymer material 1730 into the grooves of the plate 1720. If necessary, one or more overflow holes may be provided to allow any excess polymer material 1730 to escape from the club head during the pressing operation.

In some example, the polymer included in the recess 1709 may be a material different from the polymer material filling the grooves 1715 of the insert 1707. For instance, polymers of different Shore hardness values may be used for the polymer in the recess 1709 and the polymer filling the grooves 1715. In some examples, the polymer filling the grooves 1715 may have a higher Shore hardness than the polymer in the recess 1709. The harder polymer in the grooves 1715 may aid in creating top spin on the ball while the softer polymer in the recess may aid in providing a soft "feel" for the putter.

Figure 18A:
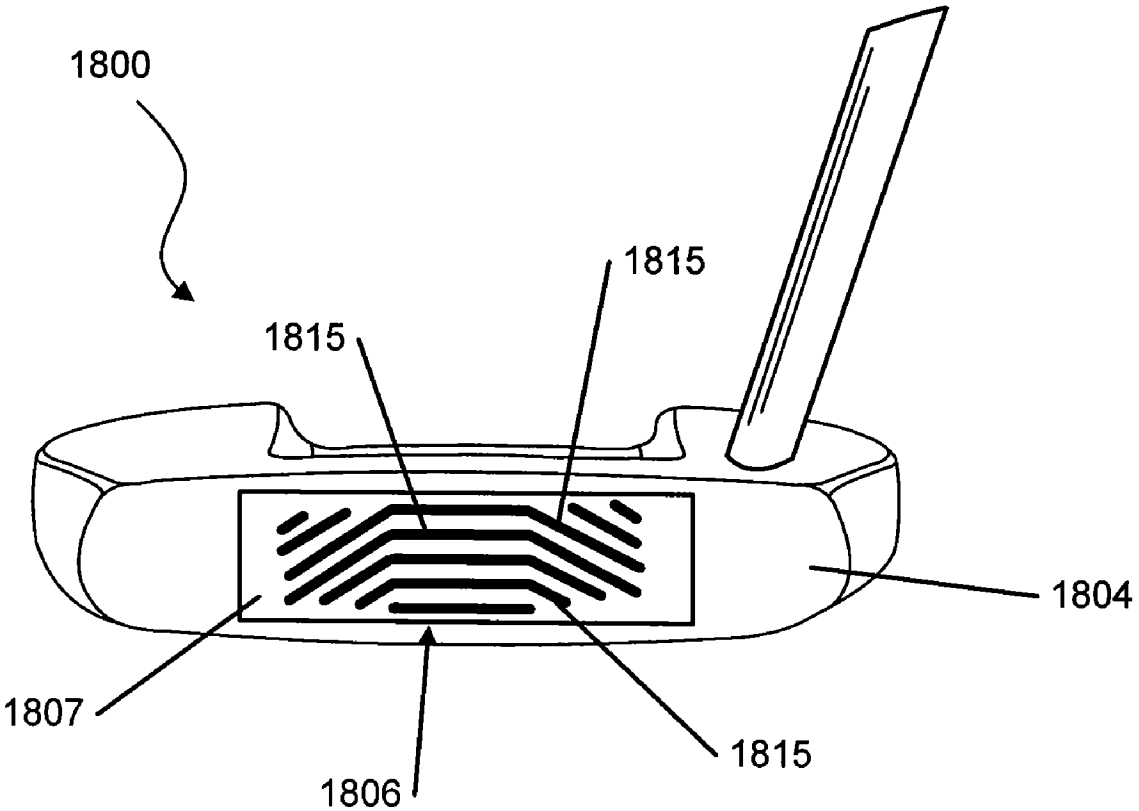
FIGS. 18A-18B illustrate another example putter arrangement having a ball striking face insert formed at least partially from a polymer material in accordance with at least some aspects of this invention.
Figure 18B:
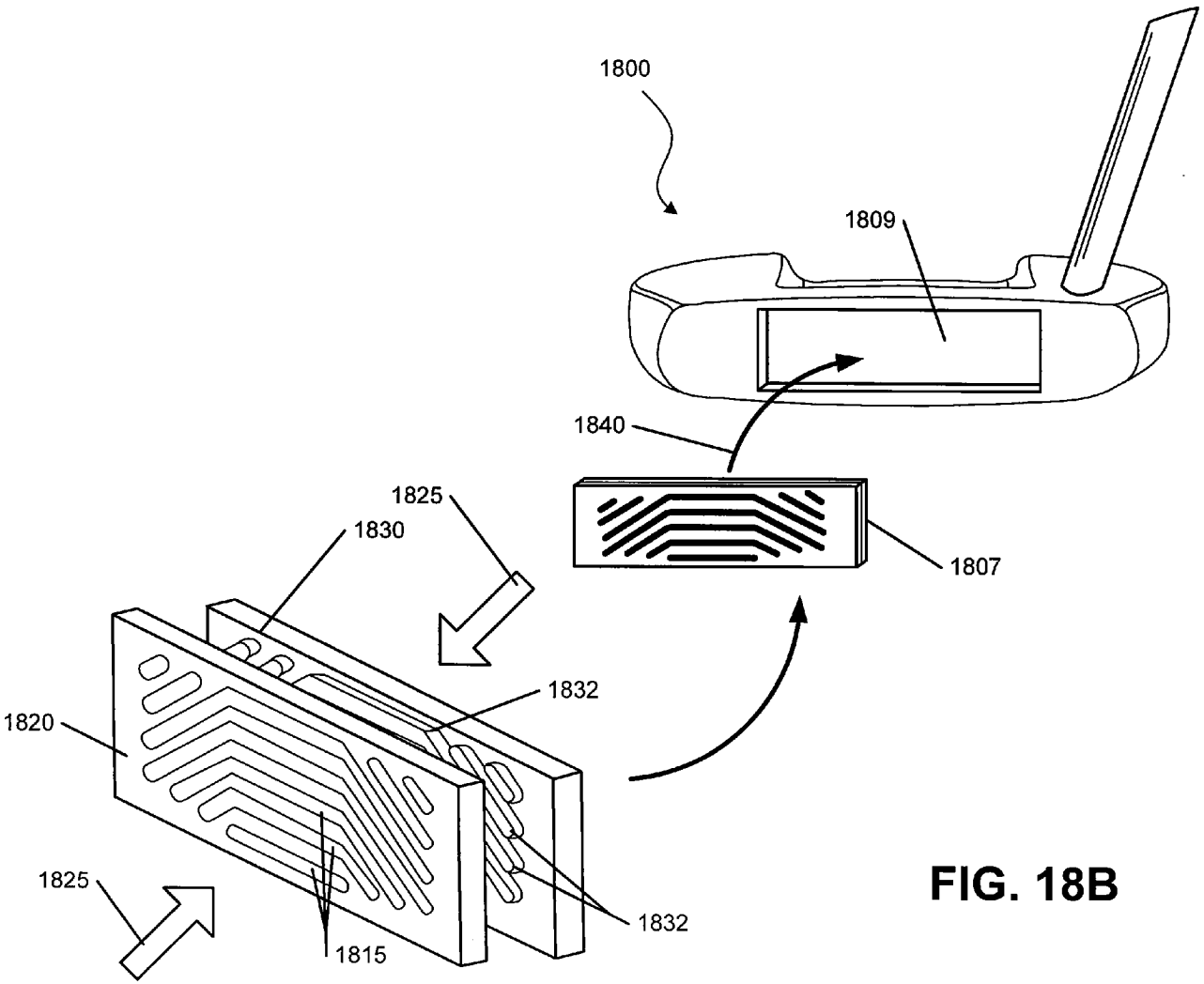

FIGS. 18A and 18B provide an alternate golf club head arrangement similar to that shown in FIGS. 17A and 17B but with the front plate portion 1820 being formed of a polymer material and with metal filling the grooves 1815. For example, golf club head 1800 includes a front face 1804 including a ball striking surface 1806. In the arrangement of FIGS. 18A and 18B, at least a portion of the ball striking surface 1806 may comprise an insert 1807. The insert 1807 may include a front plate portion 1820 (which will correspond to the front face of the putter) having a plurality of grooves 1815 formed therein. Similar to the arrangement above, the front plate 1820 may be joined with or connected to a backing plate 1830 that, in some arrangements, may be formed of metal, such as aluminum, titanium, steel, nickel, beryllium, copper, combinations or alloys including these metals, etc. In some examples, the front plate 1820 may be formed of a hard initial polymer structure (e.g., the polymer front plate 1820 may be formed of a material harder than the polymer forming portions of the insert 1707 in FIGS. 17A and 17B). This polymer structure may have scorelines formed therein during the manufacture of the front plate 1820. The front plate 1820 may then be joined with (for example, as indicated by arrows 1825) the metal backing plate 1830 to form the insert 1807.

The metal backing plate 1830 may be between 1 mm and 4 mm thick and, in some examples, may be approximately 2-3 mm thick. The metal backing plate 1830 may include a plurality of protrusions 1832 machined or formed therein. These protrusions 1832 may correspond to (and at least partially fill) grooves 1815 formed in the polymer front plate 1820 such that joining the polymer front plate 1820 to the metal backing plate 1830 allows the protrusions 1832 to extend through the grooves 1815 to form a portion of the ball striking surface of the insert 1807. Optionally, if desired, the insert's surface may be milled or finished after its assembly to assure a smooth surface is provided (with the exception of any desired scorelines).

Alternatively, as discussed above, scorelines may be cut into the polymer and/or the metal after the insert 1807 has been formed. The polymer front face 1820 and metal backing plate 1830 may, in some examples, be pressed together or co-molded and scorelines may be cut into the polymer and/or metal after the insert 1807 has been formed. In some arrangements, the insert 1807 may be formed by injection molding the polymer onto the metal plate 1830.

The insert 1807 may be engaged with the golf club head 1800 (as indicated by arrow 1840) using techniques similar to those described above. For instance, the insert 1807 may be received in a recess 1809 formed in the front face 1804 of the golf club head 1800 and connected to the recess 1809 using known techniques such as adhesives, mechanical connectors, fusing techniques, etc. Further, the insert 1807 may be releasably connected to the golf club head 1800 which may allow for customization and/or personalization, similar to the arrangements described above. Also, as noted above, the rear surface of recess 1809 may include a polymer or other material to provide a consistent base and feel for the mounted insert 1807.

Figure 19:
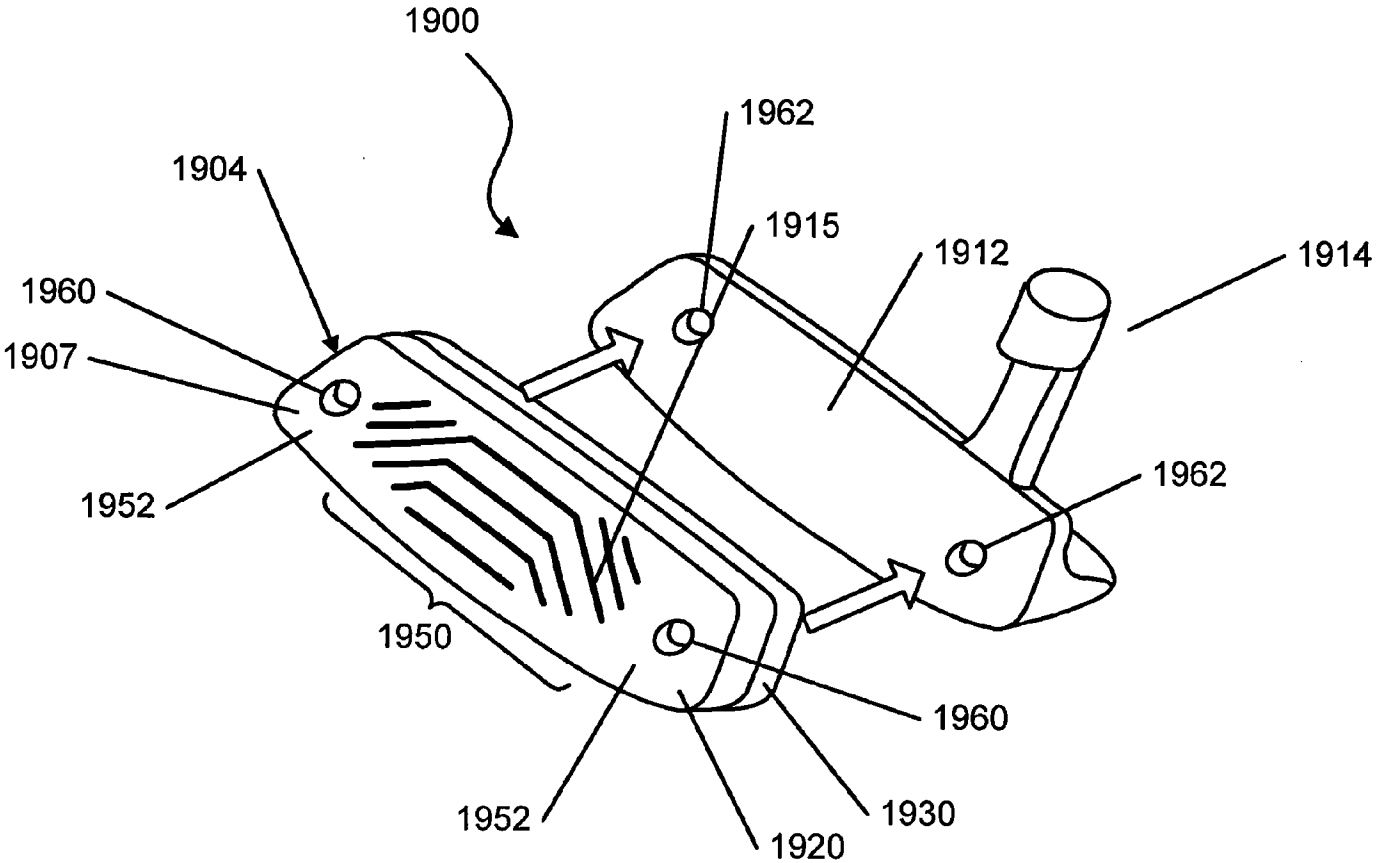
FIG. 19 illustrates an example putter having a front face plate extending across the entire front of the putter body and formed at least partially from a polymer material in accordance with at least some examples of this invention.

In some arrangements, rather than providing a face insert as shown in FIGS. 17A-18B, the entire front face of the golf club head may include a dual material structure (e.g., a metal and polymer) as described above (i.e., the dual material element may extend from a toe edge of the golf club head to a heel edge of the golf club head). FIG. 19 illustrates one example golf club head 1900 in which a front face plate 1907 forms the entire front face 1904 of the golf club head 1900. The front face plate 1907 may include a combination of materials, similar to the arrangements described above (and those described in more detail below).

The example structure shown in FIG. 19 includes a front face plate 1907 having a front plate 1920 formed of a first material and having grooves 1915 formed therein. The grooves 1915, or portions thereof, may, in some examples, extend horizontally across a portion of the front face insert 1907 when the golf club head 1900 is in a ball address position. Similar to the arrangements described above, in some examples, the grooves 1915 may form a semi-circular or curved pattern on the face. In some arrangements, the grooves 1915 may be formed in a central region 1950 of the front face plate 1907. The front face plate 1907 may also include side regions 1952, positioned on each side of the central region 1950, which may be free of grooves 1915.

The front face plate 1907 may also include a backing material or plate 1930, e.g., that is co-molded to the front plate 1920 or otherwise engaged therewith (e.g., as described above) to form the plate 1907. The backing plate 1930 may be formed of a second material that fills the grooves 1915 formed in the front plate 1920. In some arrangements, the first material forming the front plate 1920 may be a metal material while the second material forming the back plate 1930 and filling the grooves 1915 may be a polymer (similar to the arrangements shown in FIGS. 17A and 17B). In some examples, the polymer backing plate 1930 may also act as a gasket when the front plate 1920 is connected to the golf club head 1900. For instance, the polymer material forming the backing plate 1930 may aid in sealing the front face plate 1907 to the golf club head 1900 and/or a front connecting surface 1912 of the golf club head 1900 in order to prevent moisture, debris, etc. from collecting between the front face plate 1907 and the golf club head 1900 or front connecting surface 1912.

Alternatively, if desired, the material forming the front plate 1920 may be a polymer material while the material forming the backing plate 1930 may be a metal (similar to the arrangements shown in FIGS. 18A and 18B).

The front face plate 1907 may be engaged with or connected to the club head 1900 using various techniques, including conventional engagement or connection techniques as are known and used in the art. For instance, similar to the insert arrangements described above, the front face plate 1907 may be engaged with the golf club head 1900 using adhesives or cements, various fusing techniques such as welding, soldering, etc., and/or mechanical connectors. The arrangement of FIG. 19 illustrates the front face plate 1907 having apertures 1960 (optionally countersink holes) through which a mechanical connector, e.g., screws, bolts, etc., may extend to engage the plate 1907 with the golf club head 1900 (such as via threaded apertures 1962). Other connection arrangements, including releasable and/or interchangeable connection arrangements, may be used without departing from this invention.

FIG. 19 shows the rear putter base portion 1910 including a hosel member 1914 for receiving a shaft. Optionally, if desired, the front face plate 1907 could be formed to include some or all portions of the hosel member 1914. Other ways and/or structures for engaging a shaft with the putter base portion 1910 and/or the face plate 1907 may be provided without departing from the invention.

Figure 20B:
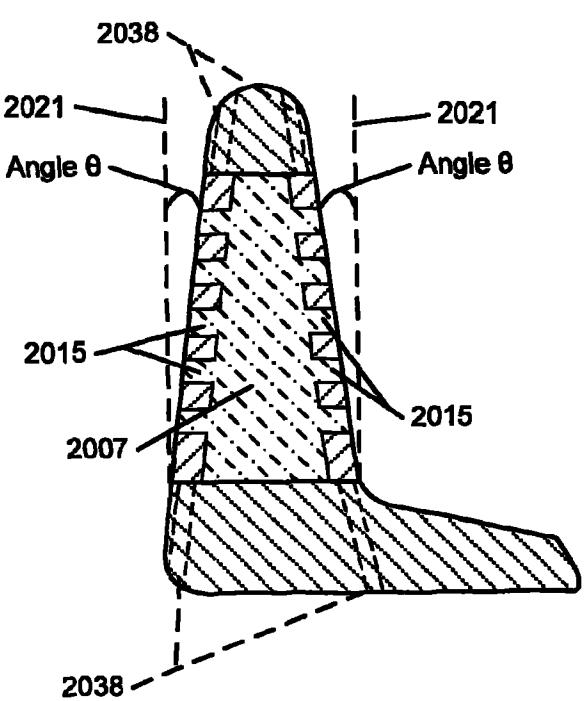
FIGS. 20A-20C illustrate one example of a two-sided putter insert formed at least partially from a polymer material in accordance with at least some aspects of this invention.
Figure 20A:
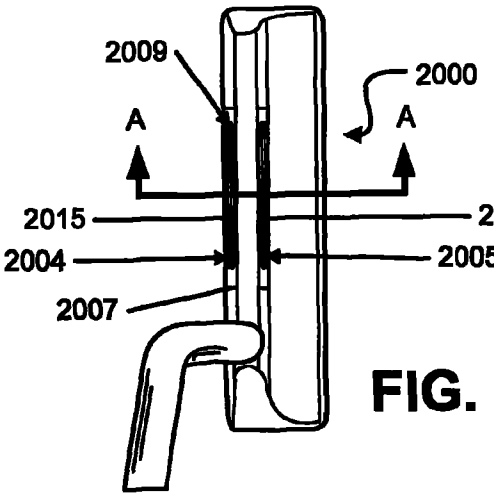
Figure 20C:
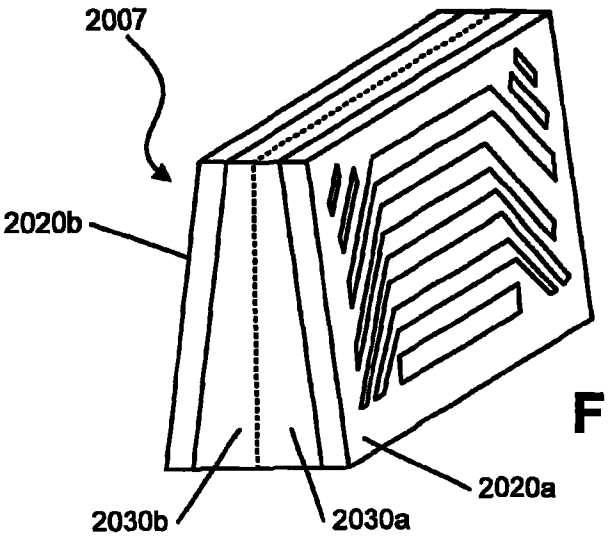

In some alternative arrangements, the insert may extend through the golf club head body such that it is visible at both the front and rear of the golf club. That is, an aperture may be formed in the putter head extending completely through a main body portion of the golf club head. The insert may be received in the aperture and may completely pass from one side of the putter to another. FIGS. 20A-20C illustrate one such arrangement in which an insert 2007 may be visible from the front 2004 and rear 2005 of the club face 2009. FIG. 20A is a top view of the golf club head 2000. As shown in FIG. 20A, grooves 2015 forming the ball striking surfaces of the insert 2007 are generally visible on both a front face 2004 of the golf club head 2000 and a rear 2005 of the face. This two-sided arrangement provides additional options for reversibility of the insert 2007 for personalization and/or customization purposes. For instance, each side of the insert 2007 may have different performance characteristics, as will be discussed more fully below.

FIG. 20B is a cross section of the golf club head 2000 of FIG. 20A taken along line A-A in FIG. 20A. Both sides of the insert 2007 are shown with grooves 2015 formed therein, as described above. As shown, each side of the insert 2007 forms an angle, θ, relative to a vertical plane, as indicate by lines 2021. In some examples, this face or loft angle, θ, may be the same on both sides of the insert 2007. Thus, regardless of which side of the insert 2007 forms the front or ball striking face 2004, the face angle of the insert 2007 within the golf club head 2000 will be consistent. In some examples, face angle θ may be between 0.5 and 6.0 degrees. However, some particular arrangements may have a face angle of 3.0 degrees or less. Still other arrangements may have a face angle of 2.5 degrees or less or even 2.0 degrees or less.

FIG. 20C illustrates the example insert 2007 having a two-sided arrangement. The insert 2007 may generally include a first metal plate 2020*a* forming a first face of the insert 2007 and a second metal plate 2020*b* forming a second face of the insert 2007. The metal plates 2020*a*, 2020*b* may be similar in size to the metal plates discussed above. Arranged between the metal plates 2020*a*, 2020*b* may be one or more polymer backing layers 2030*a*, 2030*b*. For instance, FIG. 20C illustrates an insert 2007 having two polymer backing layers 2030*a*, 2030*b*. Although two polymer backing layers 2030*a*, 2030*b* are shown, any number of layers may be used without departing from the invention. The properties of the metal plates 2020*a*, 2020*b* and/or polymer backing layers 2030*a*, 2030*b* may vary to alter the performance characteristics of each side of the insert 2007.

For example, the metal plate (such as plate 2020*a*) forming one side of the insert 2007 may be formed of a first metal while the metal plate (such as plate 2020*b*) forming the other side of the insert 2007 may be formed of a different metal, e.g., to give different sound, feel, and/or hardness properties. Additionally or alternatively, the polymers forming the backing layers 2030*a*, 2030*b* may be different polymer materials to provide different sound, feel and/or hardness properties. In still other arrangements, different groove and/or scoreline arrangements may be provided on the opposing faces of the insert 2007 (e.g., different groove or scoreline dimensions, different cross sectional sizes, different spaces, etc.) to provide different interactions with a ball. Although not shown in the arrangements of FIGS. 20A-20C, one or more faces of the putter insert 2007 may include scorelines formed in the metal and/or polymer portions, e.g., as shown in FIGS. 2C, 2D, 3, and 4.

In at least some examples, the polymer layers 2030*a*, 2030*b* arranged between the metal plates 2020*a*, 2020*b* forming each side of the insert 2007 may be a single type of polymer, optionally formed between the two plates 2020*a* and 2020*b* in a single procedure. If desired, however, one or both surfaces of the polymer may be treated differently in order to alter the performance characteristics of each side of the insert 2007. For instance, the polymer surface layers 2030*a*, 2030*b* may be formed of the same or different polymer materials and may be treated differently to provide different hardnesses to the surfaces, such as by using different curing conditions (e.g., time, temperature, radiation intensity, etc.). Varying the hardness of each side of the insert 2007 may provide an insert 2007 with sides having different feels, imparting different spin rates on the ball, different sounds, etc.

The insert 2007 may be secured to the golf club head 2000 via various releasable mechanical connection structures. For instance, various mechanical connectors (e.g., such as screws, bolts, etc.) may extend through a top and/or bottom surface of the golf club head 2000 downward to engage the insert 2007 (such as a threaded portion of the insert). See connector openings 2038 in FIG. 20B. Additionally or alternatively, mechanical connectors may extend inward from one or more sides of the golf club head 2000 to engage the insert 2007. Any manner of releasable connecting may be used.

The insert 2007 may be formed using manufacturing techniques similar to those described above (e.g., pressing, co-molding, etc.) and, in some arrangements, if desired, the polymer and metal layers may be reversed. For instance, the front face 2020*a*, 2020*b* of each side may be formed of a polymer material, while the backing layers 2030*a*, 2030*b* may be formed of a metal material. The polymer materials on each side may be the same or different materials and/or the metal materials forming the backing layers 2030*a*, 2030*b* may be the same or different materials in order to alter the performance characteristics of the insert 2007 and ultimately the golf club head 2000.

Although this reversible insert arrangement is described as being used with an aperture extending completely through the club face such that the insert 2007 is visible from the front 2004 and rear 2005 sides, in some arrangements, the reversible insert 2007 may be used with a blind hole arrangement (such as shown and described with FIGS. 17A-18B). For instance, the inserts 1707, 1807 described above with respect to FIGS. 17A-18B may be two-sided inserts, similar to insert 2007, and these inserts may be received in the recess (such as recess 1709 in FIGS. 17A, 17B or recess 1809 in FIGS. 18A, 18B) formed in the club face such that a first side is visible and forms the ball striking face. The insert may be removably or releasably connected to the front face to permit the insert to be removed and reversed, as desired. Additionally, this two-sided arrangement also may be used with the front face plate 1907 arrangement shown in FIG. 19.

Another advantage of this two-sided insert arrangement may be additional exposure of a ball striking face from a marketing perspective. For instance, when a putt is shown on television, such as during a tournament, the putting stroke is often shown or viewed from the rear (i.e., behind the golfer such that the ball, golfer and/or hole are visible in the camera view). That is, the rear of the putter, rather than the face and, more specifically, the ball striking face, is visible to the cameras (and/or to some spectators and/or playing partners). Providing a visible ball striking face at the rear of the putter allows the insert arrangement, including groove pattern and various other structural aspects, to be visually apparent during use from several different points of view.

Figure 21B:
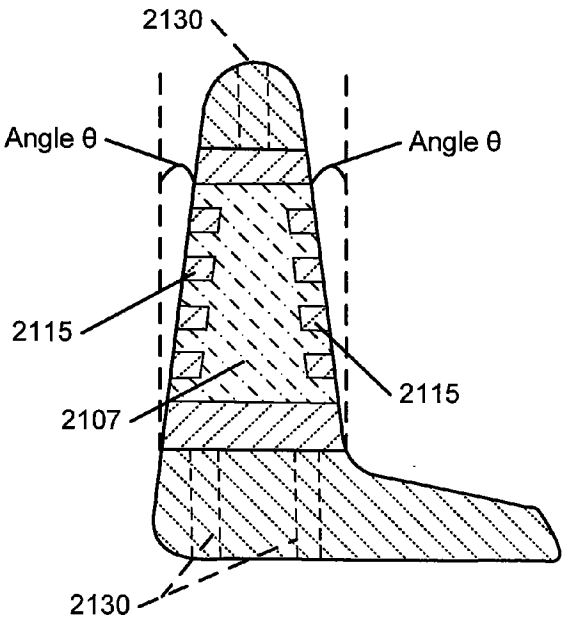
FIGS. 21A-21C illustrate another example two-sided putter insert formed at least partially from a polymer material in accordance with at least some examples of this invention.
Figure 21A:
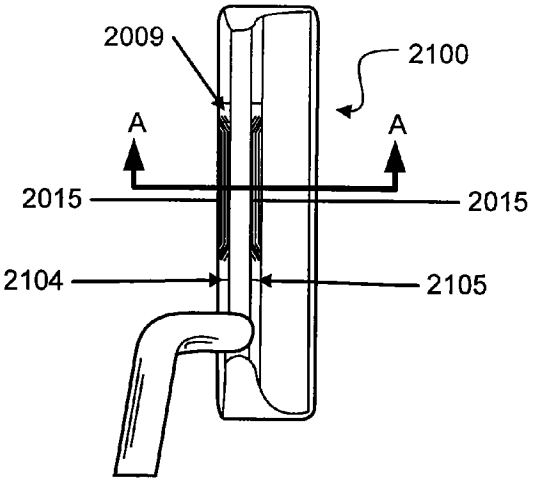
Figure 21C:
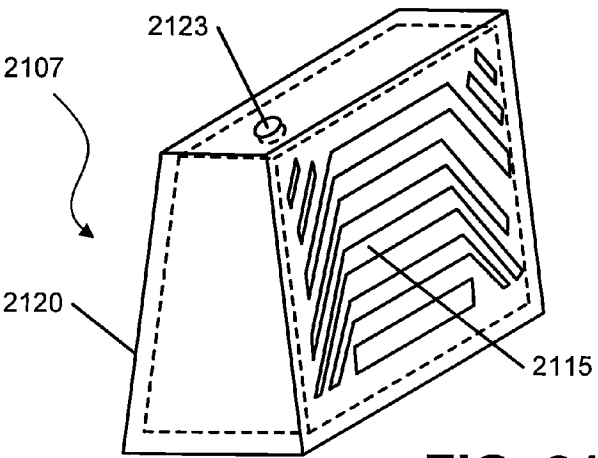

FIGS. 21A-21C illustrate an alternate arrangement of a one- or two-sided insert. In FIG. 21A, the insert 2107 is shown having a first side visible from a front 2104 of the putter and a second side visible from the rear 2105 of the putter, similar to the arrangement of FIG. 20A. The insert 2107 is a cartridge type insert that may include a metal casing 2120. The metal casing 2120 may be formed of any suitable metal, including aluminum, titanium, steel, nickel, beryllium, copper, combinations or alloys including these metals, etc., and the casing 2120 may have grooves 2115 formed therein. The metal casing 2120 may be filled with a polymer material, such a thermoplastic polyurethane, thermoset material, etc. In some examples, the metal casing 2120 may be filled with the polymer material via port 2123. Port 2123 may be sized and configured similarly to ports described above.

In some examples, forming the cartridge insert 2107 may include forming the metal casing 2120 (e.g., as one or more parts, by any desired construction technique(s)), then placing the casing 2120 in a mold with mold surfaces on the front and rear surfaces thereof, and then filling the casing 2120 with polymer (e.g., under pressure). The mold surfaces may enable score lines to be formed in the polymer as it is injected into the casing 2120, thereby reducing or eliminating a need to further process the insert 2107 to form score lines in the face. Alternatively, if desired, the scorelines (if any) may be formed in the metal and/or polymer after the polymer is filled in the casing 2120 (and optionally cured).

Cartridge type insert 2107 may include various features similar to the two-sided insert 2007 of FIGS. 20A-20C (or other inserts described herein). For instance, as shown in FIG. 21B, insert 2107 may have a face angle, θ, that may be substantially the same on both a front 2104 and rear 2105 side of the insert 2107. Similar to the arrangement of FIG. 20B, having the same, or substantially the same, face angle on both sides of the two-sided insert 2107 may aid in ensuring that the configuration of the club face remains constant regardless of which side of the insert 2107 is arranged on the front face of the golf club head 2100.

Similar to the two-sided insert 2007, insert 2107 may be secured to the golf club head 2100 using any suitable mechanical connectors. For instance, mechanical connectors may extend through a top, bottom, and/or one or more sides of the golf club head 2100 and engage with the insert 2107 to secure the insert 2107 to the golf club head 2100. See engagement holes 2130 in FIG. 21B.

In some arrangements, the metal casing 2120 may include one or more chambers formed within an interior of the casing 2120. When multiple chambers are present, these multiple chambers may allow different polymers to be arranged in different portions of the metal casing 2120. For instance, a front chamber may have a first type of polymer inserted therein while a rear chamber may have a different polymer. Additionally or alternatively, the polymers may be treated differently to alter, for example, the surface hardness characteristics of the polymer. These different polymers or different characteristics may provide different performance characteristics for each side of the insert 2107. In some examples, the metal casing may include more than one port 2123, i.e., so that each chamber may have a port associated with it.

This two-sided cartridge insert 2107 arrangement may also be used with a blind hole or recess, similar to the arrangements of FIGS. 17A-18B, or with the front face plate type arrangement of FIG. 19.

Figure 22A:
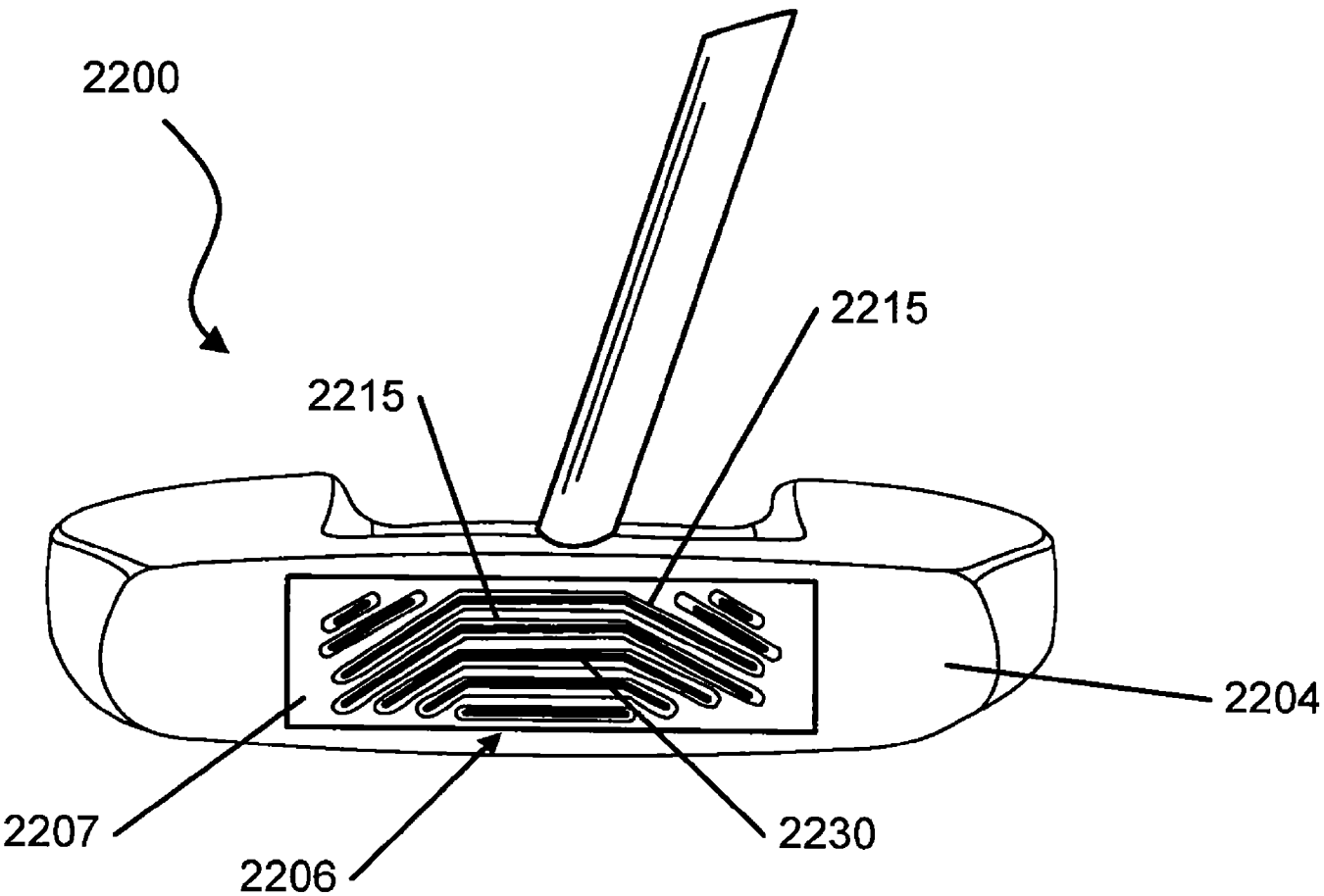
FIGS. 22A-22C illustrate one example putter arrangement having an insert formed primarily from polymer and including metal material within grooves of the polymer in accordance with at least some aspects of this invention.
Figures 22B, 22C:
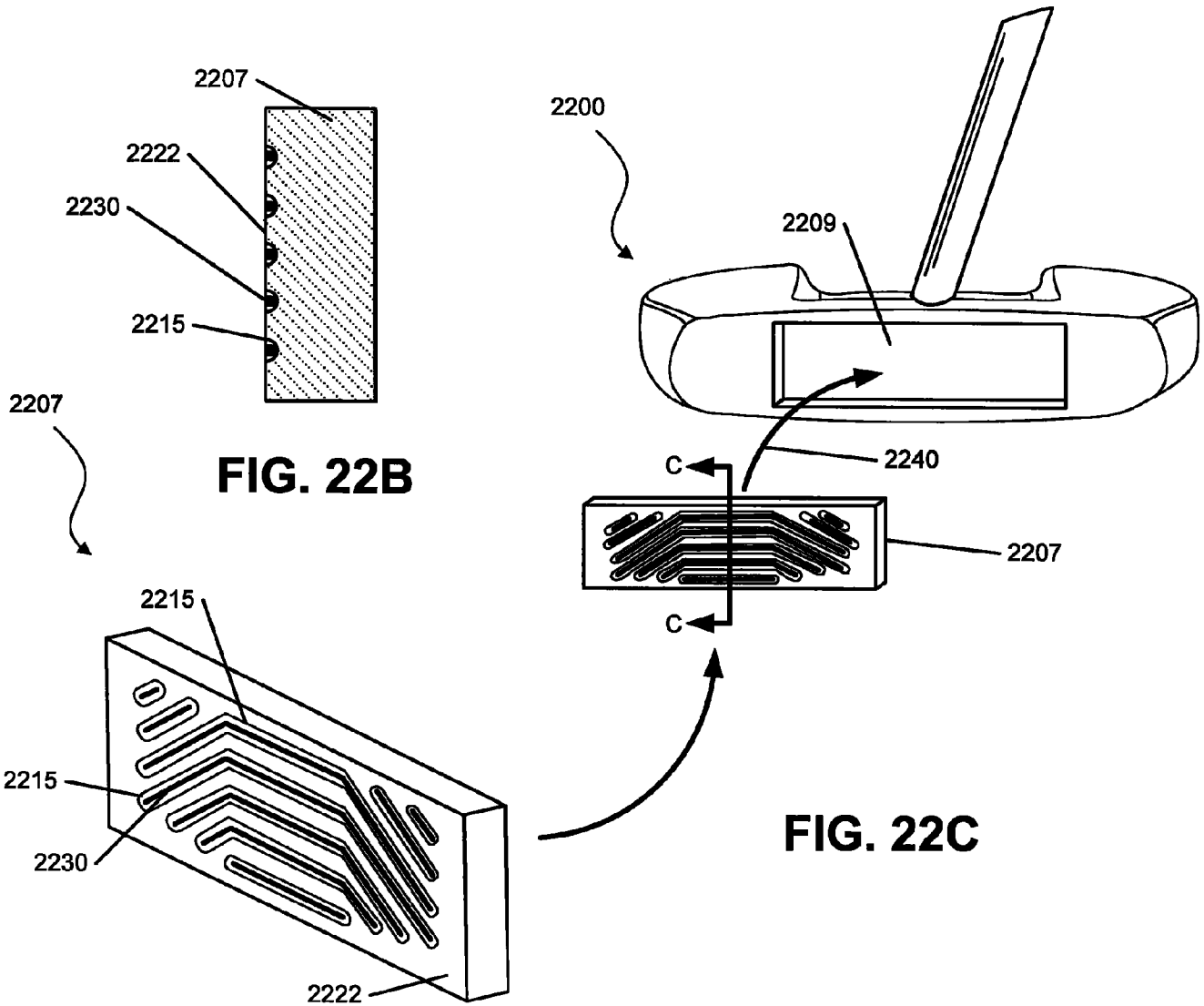

FIGS. 22A-22C illustrate yet another insert arrangement according to some example aspects of the invention described herein. In some example arrangements, the insert 2207 may be formed of plastic (polymer, e.g., thermoplastic polyurethane, thermoset polyurethanes or other polymers, etc.). Similar to the arrangements above, the insert 2207 may include grooves 2215 formed therein. The grooves 2215 may be cut or machined into the face of the insert 2207. However, in some examples, as shown in FIG. 22B, the grooves 2215 may not extend completely through the insert 2207. Rather, the grooves 2215 may be formed in the surface of the insert 2207. These grooves 2215 thus form recesses in the polymer of the insert 2207.

In some examples, a thin metal bar, strip or other metal layer 2230 is formed or laid within the grooves 2215. FIG. 22B is a cross section of the insert 2207 illustrating this groove 2215 and metal strip 2230 arrangement taken along line C-C of FIG. 22C. The metal bars or strips 2230 may be formed of any suitable metal, including aluminum, titanium, steel, nickel, beryllium, copper, combinations or alloys including these metals, etc. In some examples, the thin metal bars 2230 may be positioned in a center of the groove 2215 or recess formed in the polymer insert 2207. The metal strips 2230 and grooves 2230 formed in the insert 2207 may include edges, e.g., sharp edges, that may function as, or similarly to, scorelines provided in other arrangements described above. The metal strips 2230 may be dimensioned and arranged so that their base exterior surfaces are flush or substantially flush with the main base exterior surface 2222 of the insert 2207.

The metal strips 2230 may be provided within the grooves 2215 and/or connected to the polymer insert 2207 in any desired manner. For instance, the metal 2230 may be engaged with the insert 2207 via adhesives or cements, mechanical connectors, deposition techniques, etc.

Insert 2207 may be engaged with golf club head 2200 (as indicated by arrow 2240) using various engagement or connection techniques as described above. For instance, the insert 2207 may be connected to the recess 2209 and/or golf club head 2200 via adhesives, fusing techniques, mechanical connectors, and the like.

Optionally, if desired, a rear or back side of the insert 2207 may include a similar groove and metal strip structure, thus forming a two-sided, reversible insert similar to some arrangements described above. The rear or back side insert arrangement may optionally include a different groove pattern or configuration, different metal type, different polymer type, etc. in order to provide different sound, feel, hardnesses, etc.

In still other arrangements, the metal and polymer may be reversed to provide an insert 2207 having an opposite arrangement. For instance, the main base portion of the insert 2207 may be formed of a metal (e.g., aluminum, titanium, steel, nickel, beryllium, copper, combinations or alloys including these metals, etc.) and may have a plurality of grooves or recesses 2215 formed in a surface of the insert 2207. Strips of polymer 2230 may then be positioned within the grooves or recesses 2215, such as in a center of the grooves 2215. The edges of the metal recesses 2215 and the edges of the polymer strips 2230 may then act as scorelines, similar to other arrangements described herein.

Figure 23:
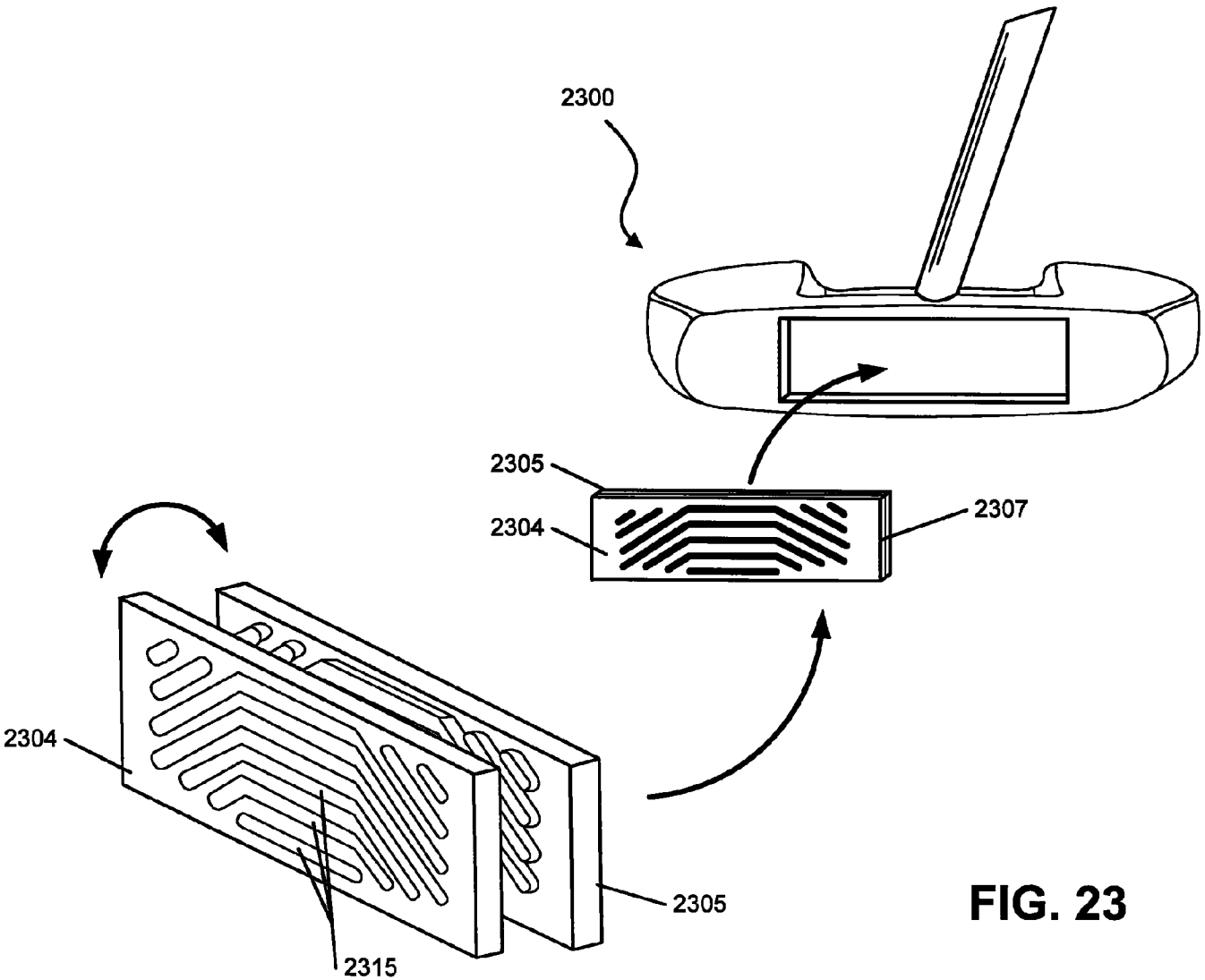
FIG. 23 illustrates yet another two-sided putter insert arrangement formed at least partially of a polymer material in accordance with at least some aspects of this invention.

FIG. 23 illustrates yet another multi-sided insert 2307 arrangement. The two-sided insert 2307 shown generally includes an insert 2307 having front 2304 and rear 2305 sides with opposite material configurations. For instance, a front side 2304 of the insert 2307 may include a metal forming the majority of the surface of the front side 2304 of the insert 2307. The metal may have grooves 2315 formed therein and the grooves 2315 may include a polymer filling material therein. In some examples, scorelines may be cut or formed in the metal and/or polymer of the front side 2304 of the insert 2307.

The rear side 2305 of the insert 2307 may include a reverse material configuration. For instance, the rear side 2305 may include a polymer forming a majority of the surface of the rear side 2305 of the insert 2307. The polymer may have grooves (not shown but may be similar to the arrangement of FIGS. 18A and 18B) formed therein and may include a metal backing (not shown) protruding through the grooves. Alternatively, the rear side may have the construction shown in FIGS. 22A through 22C. This rear side 2305, having more polymer material than metal, may be softer than the front side 2304, having more metal than polymer. Accordingly, the front 2304 and rear 2305 sides may have different performance characteristics.

The two-sided insert 2307 may be formed using one or more of the techniques described above. Further, the two-sided insert 2307 may be removably or releasably connected to the golf club head 2300 using techniques similar to those described above, such as mechanical connectors. Accordingly, a user may select to use either the front side 2304 or the rear side 2305 as the ball striking portion of the golf club head 2300, as desired.

The two-sided insert 2307 may have one or more of the properties and/or characteristics of any of the arrangements described above. For instance, the two-sided insert 2307 may include color, logos, etc. in order to provide customization and/or personalization to the golf club head 2300.

Figure 24:
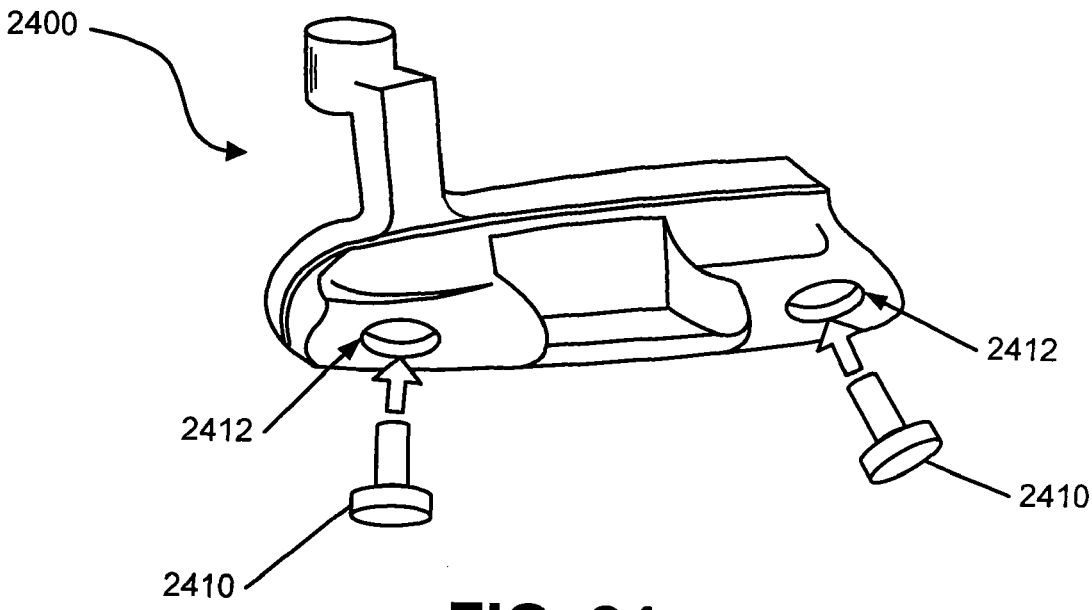
FIG. 24 illustrates one example putter arrangement in which additional weight members are arranged in a rear of the putter body in accordance with at least some aspects of this invention.

FIG. 24 illustrates still another example feature of the invention described herein. In the arrangements described above, and as discussed above, the polymer material is generally a lightweight material, relative to various metals that may be used in putter constructions. Accordingly, use of a polymer in some or all of the golf club head construction aids in reducing the overall weight associated with the golf club head. This reduction in weight may also permit redistribution or repositioning of weight associated with the golf club head. For instance, additional weight may be added or shifted to various regions of the golf club head in order to alter the performance characteristics of the golf club head.

In one example, it may be desirable to reposition weight associated with the club head to various locations within the club head structure, such as rearward and toward the side edges (e.g., to increase the club head's moment of inertia, particularly the Izz moment (about a vertical axis through the club head's center of gravity)). The arrangement of FIG. 24 includes one or more weights 2410, formed of a more dense or heavier material than at least portions of the remainder of the golf club head, such as tungsten, lead, or materials containing tungsten or lead, arranged on a rear of the golf club head 2400. In some examples, the weights 2410 may be removable and/or interchangeable with weights that may be heavier or lighter than the original weights 2410, for customization and/or personalization features.

The weights 2410 may be connected to the golf club head 2400 using various techniques. In one example, the tungsten weights 2410 may be provided in weight ports 2412 that may include threaded openings in which screws, bolts, or other mechanical connectors may be inserted for holding the insert in the club head body. The screws, bolts, etc. may secure the insert to the club head body and may, in some arrangements, also provide the desired weight and/or secure external weights 2410 to the club head body.

Figure 25A:
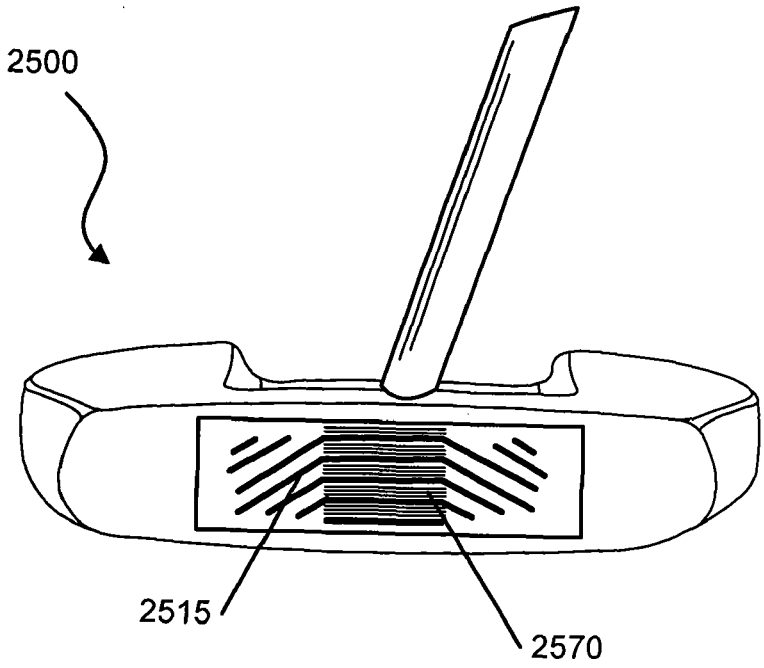
FIGS. 25A-25C illustrate microgrooves that may be formed in one or more putter head arrangements described herein in accordance with at least some aspects of this invention.
Figure 25C:
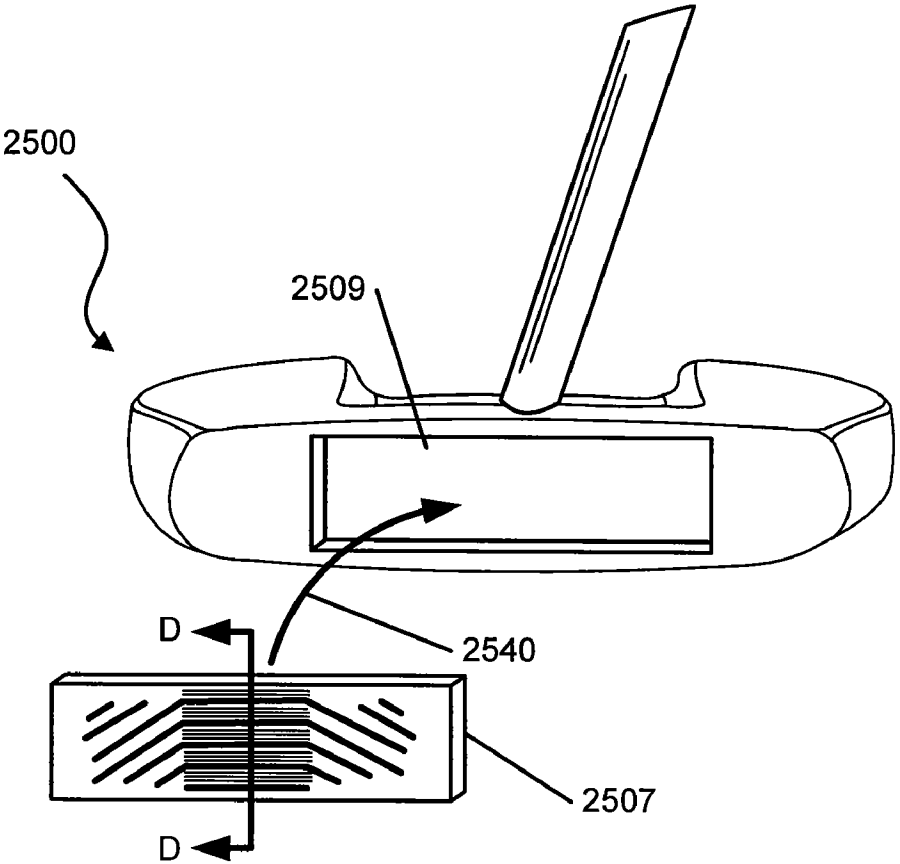
Figure 25B:
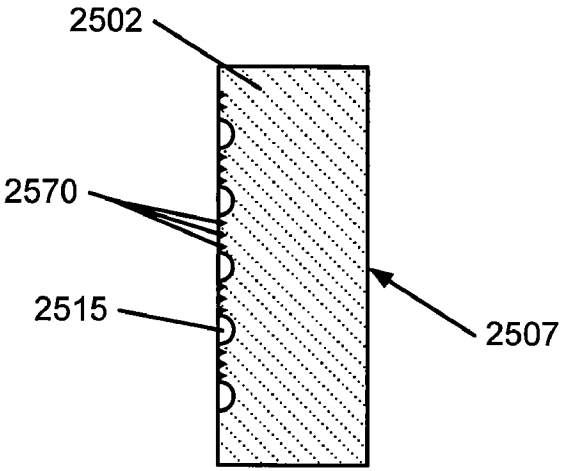

FIGS. 25A-25C illustrate additional example features that may be included in any of the arrangements described above. FIG. 25A illustrates an example golf club head 2500 having an insert 2507 according to any of the above arrangements, wherein the ball striking surface of the insert includes a plurality of microgrooves 2570 formed between the larger groove structures (e.g., between grooves 2515). In some examples, the microgrooves 2570 may be about 1 micron to 1 mm wide and deep. The microgrooves 2570 may be cut into the metal or polymer base material in any desired manner, such as by using a laser. Any number of microgrooves 2570 may be cut into the metal or polymer base material, and the microgrooves 2570 may have any desired curvature, cross section, and/or relative arrangement or orientation, as desired. Further, the microgrooves 2570 may be cut into each area between the larger groove areas 2515 or, alternatively, the microgrooves 2570 may be cut in any other desired areas.

FIG. 25B is an enlarged cross section of the insert 2507 taken along line D-D in FIG. 25C. The insert 2507 includes a base material 2502 that may be a polymer, such as thermoplastic polyurethane or thermoset material, or a metal, such as aluminum, titanium, steel, nickel, beryllium, copper, combinations or alloys including these metals, etc. Similar to the arrangements described above, the base material 2502 includes a plurality of grooves 2515 cut into it. The plurality of microgrooves 2570 cut into the base material between the larger groove areas 2515 is also shown. As mentioned above, any number of microgrooves 2570 may be cut into the base material within the width provided between the larger groove areas (e.g., 2, 3, 4, 5, or more microgrooves 2570).

The insert 2507 may be engaged with the golf club head 2500 (as indicated by arrow 2540) using any of the techniques and/or methods described above. For instance, the insert 2507 may engaged with the club head 2500 via recess 2509 using adhesives, fusing techniques, mechanical connectors, etc. Although the insert 2507 is shown as engaging the club head 2500 via a recess 2509 or blind hole, microgrooves 2570 may be used in conjunction with any of the arrangements described herein, including two-sided inserts, inserts forming the entire face of the putter, inserts received in an aperture extending entirely through the club head, etc. Microgrooves 2570 also may be provided in the various arrangements described above in conjunction with FIGS. 1A through 16.

Figure 26A:
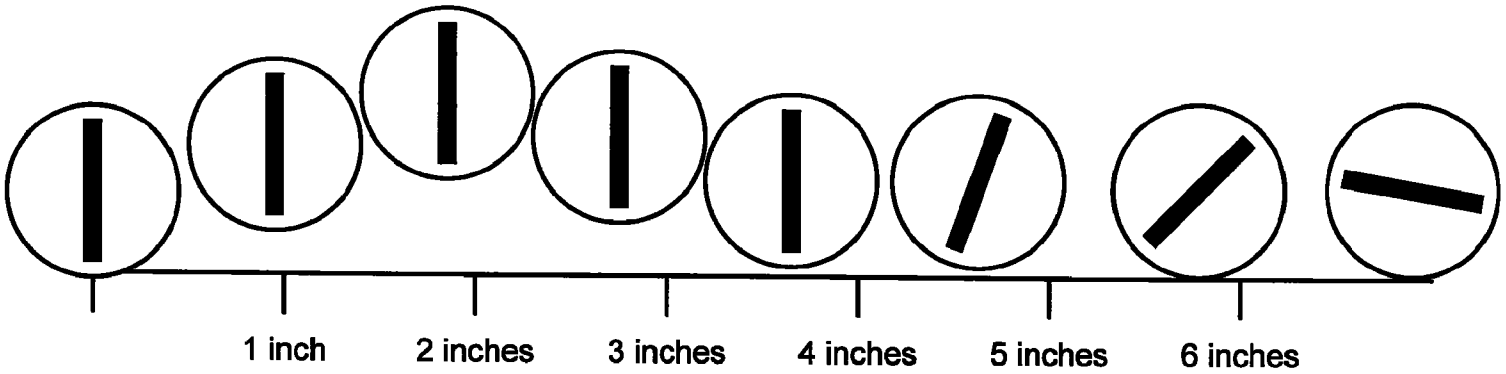
FIG. 26A (Prior Art)
FIGS. 26A and 26B illustrate example trajectories of a ball during a putt when the ball is putted with a conventional putter and with a putter in accordance with at least some examples of this invention, respectively.
Figure 26B:
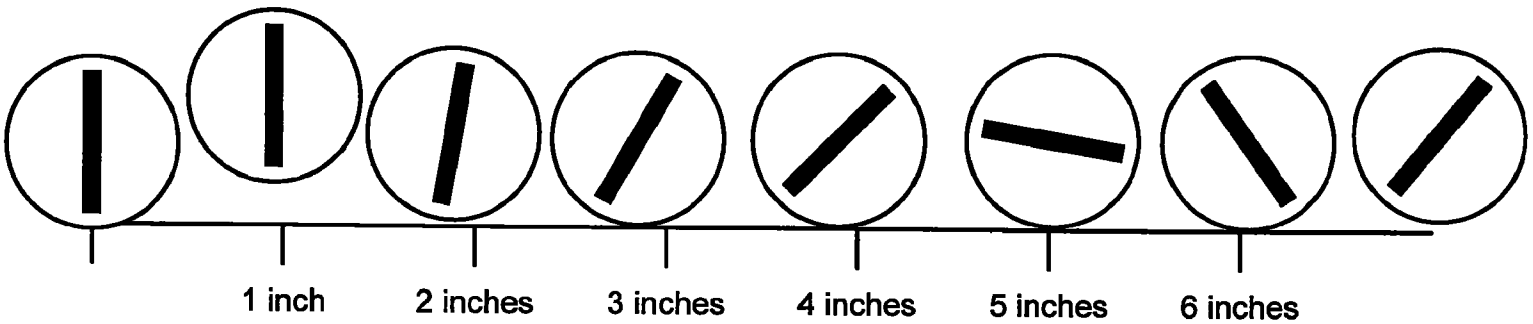

FIGS. 26A and 26B illustrate some example effects of various features of this invention, particularly in the presence of the relatively soft polymer fill material in the club head body material (e.g., a thermoplastic polyurethane, which can somewhat grip the ball) and/or a relatively soft ball cover material. More specifically, various advantageous aspects of the invention may be provided by including sharp scorelines in the polymer and/or metal (to provide sharp edges on the putter face that can help grip the ball) and by providing a relatively low loft angle on the putter face (e.g., about 2 degrees as compared to 4 degrees for conventional putters).

First, as a ball sits on the green, its weight forces it down somewhat into the grass. When putting, the putter must first somewhat "pop" the ball out of this settled condition. Therefore, putter faces generally have some loft to help launch the ball at an upward angle (as mentioned in various arrangements above). This upward angle, however, propels the ball upward (in some instances the ball may actually leave the ground), which causes it to fly or skid across the green before it begins a true roll, as shown in FIG. 26A. This bounce or skid can present some inconsistency in speed, because the ball does not always "fly" or "skid" the same amount, and it can end up taking inconsistent amounts of energy off the ball during the transition between the flying and skidding mode to the rolling mode. In some instances, the loft of the club can actually put a small amount of backspin on the ball.

Putter structures in accordance with at least some examples of this invention, however, may provide quicker and truer roll as compared to conventional putters. As noted above, because of the soft polymer materials and the sharp edges in the polymer and metal (e.g., from the scorelines), the putter face tends to "grip" the ball a bit better during a putt. This helps "pop" the ball out of its settled condition somewhat more easily and tends to better induce top spin on the ball (which tends to keep the ball on the ground and get it rolling somewhat more quickly). Also, these features allow the putter head to have a less lofted face angle (e.g., 2 degrees vs. a conventional 4 degrees). Thus, the ball does not tend to launch as high out of the settled condition, causing it to more quickly contact the ground once out of the settled position, and the induced top spin gets it rolling more quickly. A schematic diagram of an example trajectory of the ball using an example putter according to this invention is shown in FIG. 26B.

The microgrooves, as described in conjunction with the arrangement illustrated in FIGS. 25A-25C can also enhance the ball grip and imparting top spin on the ball.

As shown in FIGS. 26A and 26B, putters in accordance with examples of this invention may get the ball rolling much earlier during the course of a putt (e.g., within about 2 inches or less for the putters according to the invention vs. at about 4 to 5 inches for conventional putters). Moreover, by getting the ball rolling earlier, with less bounce and skid (and the uncertainty introduced into the putt due to these undesired factors), putters in accordance with examples of this invention tend to provide more reliable and repeatable putting distances, putted ball speeds, and distance control.

Moreover, the combination of metal and polymer on the face of the putter provides a nice, soft and consistent feel (optionally controllable by selecting the hardnesses of the various parts) while still providing a more conventional "metal-on-ball" sound (or "click") of conventional putters. This sound feature also is an important part of the "feel" for many golfers, and maintaining this metallic sound helps prevent a more "dead" sound of putting a ball against a full polymer material on a putter face (e.g., as provided in many conventional putters that simply have a polymer insert).

Any desired polymeric material may be used without departing from this invention, including thermoplastic or thermosetting polymeric materials, synthetic rubber type polymeric materials, etc., such as polyurethanes, vinyls (e.g., ethylvinylacetates, etc.), nylons, polyethers, polybutylene terephthalates, etc. Additionally or alternatively, recycled materials, such as recycled polymer materials, may be used in any of the above-described arrangements without departing from the invention. In some examples, portions of the club head, insert, golf club grip, etc. may be formed a recycled material such as regrind. Regrind may include additives used in the formation portions of the ball striking surface, club head, grip, etc. that may include finely ground recycled materials. In some examples, the finely ground recycled materials may be recycled footwear materials that may be scraps, shavings, etc. generated during manufacture, defective or used articles of footwear, and the like. The additives may include leather, cotton, thermoplastics, synthetic and natural rubber, millable/partially cross-linked polyurethane, and synthetic fibers. The thermoplastics may include polyamides, polyesters and polyurethanes.

In some examples, the regrind additives may be ground to a desired particle size and added to raw material (such as new polymeric material) to form the desired portions of the club head, grip, ball striking surface, insert, etc. In other instances, the desired portions may be formed entirely of regrind. One advantage of using regrind materials in forming portions of the golf club, such as the ball striking surface, grip, insert, etc., is the reduction in waste associated with the manufacture of the articles being ground into regrind and the reduction in first-use materials in manufacturing portions of the golf club. The use of recycled materials generally reduces waste that would have consumed landfill space and aids in reducing the carbon footprint of manufacturers. Additional examples of regrind materials, manufacture, etc. may be found in U.S. Pat. No. 5,346,934 to Chriss, entitled "Footwear Additive Made From Recycled Materials," which is incorporated herein by reference in its entirety.

Putters and putter heads may have any desired constructions, materials, dimensions, loft angles, lie angles, colors, designs, and the like without departing from this invention, including conventional constructions, materials, dimensions, loft angles, lie angles, colors, designs, and the like, as are known and used in the art.

Conclusion

Of course, many modifications to the putter and putter head structures and/or methods for making these structures may be used without departing from the invention. For example, with respect to the structures, grips, aiming indicia or markings, other indicia or markings, different types of putter heads, various shaft curvatures and/or shapes, various shaft connecting member shapes, and/or other structural elements may be provided and/or modified in the structure without departing from the invention. With respect to the methods, additional production steps may be added, various described steps may be omitted, the steps may be changed and/or changed in order, and the like, without departing from the invention. Therefore, while the invention has been described with respect to specific examples including presently preferred modes of carrying out the invention, those skilled in the art will appreciate that there are numerous variations and permutations of the above described structures and methods. Thus, the spirit and scope of the invention should be construed broadly as set forth in the appended claims.

We claim:

1. A putter head, comprising:

a putter head body having a front face;

a recess formed in the front face; and a ball striking surface insert configured to be received in the recess, the ball striking surface insert forming at least a portion of an exposed ball striking surface of the putter head, the exposed ball striking surface including a first strip of polymeric material, with metal material provided adjacent and above the first strip of polymeric material and adjacent and below the first strip of polymeric material, wherein the exposed ball striking surface includes a first groove defined therein, wherein a first edge of the first groove is defined by the metal material and a second edge of the first groove opposite the first edge is defined by the first strip of polymeric material, and wherein the ball striking surface insert is mounted with respect to the putter head body and recess so as to produce a loft angle of less than 3 degrees.

2. A putter head according to claim 1, wherein the first strip of polymeric material at the exposed ball striking surface includes: (a) a first horizontal linear segment extending in a heel-to-toe direction when the putter head is oriented in a ball address position, (b) a first slanted linear segment located at a first end of the first horizontal linear segment, and (c) a second slanted linear segment located at a second end of the first horizontal linear segment.

3. A putter head according to claim 1, wherein the exposed ball striking surface includes a second strip of polymeric material, with metal material provided adjacent and above the second strip of polymeric material and adjacent and below the second strip of polymeric material, wherein the exposed ball striking surface further includes a second groove defined therein, wherein a first edge of the second groove is defined by the metal material and a second edge of the second groove opposite the first edge is defined by the second strip of polymeric material.

4. A putter head according to claim 3, wherein the first strip of polymeric material at the exposed ball striking surface includes: (a) a first horizontal linear segment extending in a heel-to-toe direction when the putter head is oriented in a ball address position, (b) a first slanted linear segment located at a first end of the first horizontal linear segment, and (c) a second slanted linear segment located at a second end of the first horizontal linear segment; and wherein the second strip of polymeric material at the exposed ball striking surface includes: (a) a second horizontal linear segment extending in the heel-to-toe direction when the putter head is oriented in the ball address position, (b) a third slanted linear segment located at a first end of the second horizontal linear segment, and (c) a fourth slanted linear segment located at a second end of the second horizontal linear segment.

5. A putter head according to claim 4, wherein the first and second horizontal linear segments are parallel, wherein the first and third slanted linear segments are parallel, and wherein the second and fourth slanted linear segments are parallel.

6. A putter head according to claim 3, wherein the exposed ball striking surface includes a third strip of polymeric material, with metal material provided adjacent and above the third strip of polymeric material and adjacent and below the third strip of polymeric material, wherein the exposed ball striking surface further includes a third groove defined therein, wherein a first edge of the third groove is defined by the metal material above the third strip of polymeric material and a second edge of the third groove opposite the first edge is defined by the third strip of polymeric material.

7. A putter head according to claim 6, wherein the first strip of polymeric material at the exposed ball striking surface includes: (a) a first horizontal linear segment extending in a heel-to-toe direction when the putter head is oriented in a ball address position, (b) a first slanted linear segment located at a first end of the first horizontal linear segment, and (c) a second slanted linear segment located at a second end of the first horizontal linear segment;

wherein the second strip of polymeric material at the exposed ball striking surface includes: (a) a second horizontal linear segment extending in the heel-to-toe direction when the putter head is oriented in the ball address position, (b) a third slanted linear segment located at a first end of the second horizontal linear segment, and (c) a fourth slanted linear segment located at a second end of the second horizontal linear segment; and wherein the third strip of polymeric material at the exposed ball striking surface includes: (a) a third horizontal linear segment extending in the heel-to-toe direction when the putter head is oriented in the ball address position, (b) a fifth slanted linear segment located at a first end of the third horizontal linear segment, and (c) a sixth slanted linear segment located at a second end of the third horizontal linear segment.

8. A putter head according to claim 7, wherein the first, second, and third horizontal linear segments are parallel, wherein the first, third, and fifth slanted linear segments are parallel, and wherein the second, fourth, and sixth slanted linear segments are parallel.

9. A putter head according to claim 1, wherein the loft angle is between 2 degrees and 3 degrees.

10. A putter head according to claim 1, wherein the loft angle is about 2 degrees.

11. A putter head, comprising:

a putter body having a front face;

a recess formed in the front face; and a ball striking surface insert configured to be received in the recess and forming at least a portion of an exposed ball striking surface of the putter head, the ball striking surface insert including:

a front portion formed of a first polymeric material and having a first elongated opening formed therein, and a backing portion engaged with the front portion, the backing portion being formed of a second polymeric material having a different hardness from the first polymeric material, and wherein the backing portion extends into the first elongated opening and forms a first strip of the second polymeric material exposed at the exposed ball striking surface, wherein the exposed ball striking surface includes a first groove defined therein, wherein a first edge of the first groove is defined by the first polymeric material and a second edge of the first groove opposite the first edge is defined by the second polymeric material exposed through the first elongated opening.

12. A putter head according to claim 11, wherein the first strip of the second polymeric material at the exposed ball striking surface includes: (a) a first horizontal linear segment extending in a heel-to-toe direction when the putter head is oriented in a ball address position, (b) a first slanted linear segment located at a first end of the first horizontal linear segment, and (c) a second slanted linear segment located at a second end of the first horizontal linear segment.

13. A putter head according to claim 11, wherein the front portion of the ball striking surface insert includes a second elongated opening formed therein, wherein the backing portion extends into the second elongated opening and forms a second strip of the second polymeric material exposed at the exposed ball striking surface, and wherein the exposed ball striking surface includes a second groove defined therein, wherein a first edge of the second groove is defined by the first polymeric material and a second edge of the second groove opposite the first edge is defined by the second polymeric material exposed through the second elongated opening.

14. A putter head according to claim 13, wherein the first strip of the second polymeric material at the exposed ball striking surface includes: (a) a first horizontal linear segment extending in a heel-to-toe direction when the putter head is oriented in a ball address position, (b) a first slanted linear segment located at a first end of the first horizontal linear segment, and (c) a second slanted linear segment located at a second end of the first horizontal linear segment, and wherein the second strip of the second polymeric material at the exposed ball striking surface includes: (a) a second horizontal linear segment extending in the heel-to-toe direction when the putter head is oriented in the ball address position, (b) a third slanted linear segment located at a first end of the second horizontal linear segment, and (c) a fourth slanted linear segment located at a second end of the second horizontal linear segment.

15. A putter head according to claim 14, wherein the first and second horizontal linear segments are parallel, wherein the first and third slanted linear segments are parallel, and wherein the second and fourth slanted linear segments are parallel.

16. A putter head according to claim 13, wherein the front portion of the ball striking surface insert includes a third elongated opening formed therein, wherein the backing portion extends into the third elongated opening and forms a third strip of the second polymeric material exposed at the exposed ball striking surface, and wherein the exposed ball striking surface includes a third groove defined therein, wherein a first edge of the third groove is defined by the first polymeric material and a second edge of the third groove opposite the first edge is defined by the second polymeric material exposed through the third elongated opening.

17. A putter head according to claim 16, wherein the first strip of the second polymeric material at the exposed ball striking surface includes: (a) a first horizontal linear segment extending in a heel-to-toe direction when the putter head is oriented in a ball address position, (b) a first slanted linear segment located at a first end of the first horizontal linear segment, and (c) a second slanted linear segment located at a second end of the first horizontal linear segment, wherein the second strip of the second polymeric material at the exposed ball striking surface includes: (a) a second horizontal linear segment extending in the heel-to-toe direction when the putter head is oriented in the ball address position, (b) a third slanted linear segment located at a first end of the second horizontal linear segment, and (c) a fourth slanted linear segment located at a second end of the second horizontal linear segment, and wherein the third strip of the second polymeric material at the exposed ball striking surface includes: (a) a third horizontal linear segment extending in the heel-to-toe direction when the putter head is oriented in the ball address position, (b) a fifth slanted linear segment located at a first end of the third horizontal linear segment, and (c) a sixth slanted linear segment located at a second end of the third horizontal linear segment.

18. A putter head according to claim 17, wherein the first, second, and third horizontal linear segments are parallel, wherein the first, third, and fifth slanted linear segments are parallel, and wherein the second, fourth, and sixth slanted linear segments are parallel.

19. A putter head according to claim 11, wherein the ball striking surface insert is mounted with respect to the putter head body and recess so as to produce a loft angle of between 2 degrees and 3 degrees.

20. A putter head according to claim 11, wherein the ball striking surface insert is mounted with respect to the putter head body and recess so as to produce a loft angle of about 2 degrees.

21. A putter head according to claim 11, wherein the ball striking surface insert is mounted with respect to the putter head body and recess so as to produce a loft angle of less than 3 degrees.

* * * * *